US007610008B2

(12) United States Patent
Watanabe et al.

(10) Patent No.: US 7,610,008 B2
(45) Date of Patent: Oct. 27, 2009

(54) CLEANING DEVICE, AND PROCESS UNIT AND IMAGE FORMING APPARATUS INCLUDING THE CLEANING DEVICE

(75) Inventors: Kazuhiko Watanabe, Koganei (JP); Osamu Naruse, Yokohama (JP); Masahiko Shakuto, Zama (JP); Hidetoshi Yano, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 514 days.

(21) Appl. No.: 11/455,825

(22) Filed: Jun. 20, 2006

(65) Prior Publication Data

US 2006/0285898 A1 Dec. 21, 2006

(30) Foreign Application Priority Data

Jun. 20, 2005 (JP) ..... 2005-179622
Sep. 8, 2005 (JP) ..... 2005-260645

(51) Int. Cl.
*G03G 21/00* (2006.01)

(52) U.S. Cl. ..... 399/350; 399/343; 399/351

(58) Field of Classification Search ..... 399/343, 399/350, 351

See application file for complete search history.

(56) References Cited

U.S. PATENT DOCUMENTS 6,044,245 A * 3/2000 Kabashima et al. ..... 399/350
6,640,080 B2 * 10/2003 Endo et al. ..... 399/350
2004/0234294 A1 11/2004 Nagame et al.
2005/0130050 A1 * 6/2005 Takada et al. ..... 430/45
2006/0099016 A1 5/2006 Watanabe et al.
2009/0123205 A1 5/2009 Watanabe et al.

FOREIGN PATENT DOCUMENTS

JP 5-19671 1/1993
JP 11-95631 4/1994
JP 6-42079 6/1994
JP 7-104626 4/1995

(Continued)

OTHER PUBLICATIONS

Abstract of JP07104627A, Mihashi.*
Abstract of JP07104627A, Mihashi dated Apr. 21, 1995.*
U.S. Appl. No. 12/109,648, filed Apr. 25, 2008, Hozumi, et al.
U.S. Appl. No. 12/137,158, filed Jun. 11, 2008, Naruse, et al.

(Continued)

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

A cleaning device including an elastic blade whose tip is contacted with a surface of a rotating member in such a manner as to counter the rotated member to remove particles of a toner on the rotated member; and a holder configured to support the elastic blade, wherein a nip formed by longitudinal end portions of the tip of the blade and the surface of the rotated member has a first nip width in a rotation direction of the rotated member, and a nip formed by a central portion of the blade and the surface of the rotated member has a second nip width, and wherein the first nip width is less than the second nip width.

20 Claims, 19 Drawing Sheets

FOREIGN PATENT DOCUMENTS

| | | | |
|---|---|---|---|
| JP | 07104627 A | * | 4/1995 |
| JP | 11-237819 | | 8/1999 |
| JP | 11-327395 | | 11/1999 |
| JP | 2001-51566 | | 2/2001 |
| JP | 2002-258701 | | 9/2002 |
| JP | 3484952 | | 10/2003 |
| JP | 2004-279518 | | 10/2004 |

OTHER PUBLICATIONS

U.S. Appl. No. 12/031,333, filed Feb. 14, 2008, Sugimoto, et al.
U.S. Appl. No. 12/030,608, filed Feb. 13, 2008, Sugimoto, et al.
U.S. Appl. No. 11/852,643, filed Sep. 10, 2007, Hozumi, et al.

* cited by examiner

PERIPHERAL LENGTH : L1

CIRCLE HAVING AREA S

CLEANING DEVICE, AND PROCESS UNIT AND IMAGE FORMING APPARATUS INCLUDING THE CLEANING DEVICE

BACKGROUND OF THE INVENTION

1. Field of the Invention

The present invention relates to a cleaning device, and more particularly to a cleaning device for use in removing toner particles on a member (such as image bearing members and intermediate transfer media) of an image forming apparatus such as copiers, facsimiles and printers. In addition, the present invention also relates to a process unit and an image forming apparatus including a cleaning device.

2. Discussion of the Background

In electrophotographic image forming apparatuses, toner particles remaining on a toner image bearing member such as image bearing members and intermediate transfer media even after a primary or secondary image transfer operation are removed therefrom with a cleaning device. Among various cleaning devices, blade cleaning devices are typically used because of having a simple structure and a good cleanability. A cleaning blade used for such blade cleaning devices is typically made of a polyurethane rubber and is set such that the tip edge of the blade is pressure-contacted with the peripheral surface of a toner image bearing member while the rear end portion of the blade is supported with a support to block and scrape off toner particles on a toner image bearing member. In general, a cleaning blade is attached to a toner image bearing member so as to be contacted with the entire surface of the toner image bearing member in the main image-scanning direction (i.e., the width direction of the toner image bearing member). Namely, the cleaning blade is contacted with an image forming region (i.e., the central portion of the member) and non-image forming regions (i.e., side end portions of the member). Such a cleaning device is disclosed in, for example, published unexamined Japanese patent application No. (hereinafter referred to as JP-A) 2002-258701.

In order to well cleaning the surface of a toner image bearing member in the width direction thereof using a cleaning blade, the cleaning blade is preferably set so as to be contacted with the surface of the toner image bearing member at substantially the same pressure in the width direction. However, it is difficult to set a cleaning blade in such a manner. For example, parts constituting a cleaning blade have variations in size and therefore the cleaning blade assembled using such parts has also variations in size. When such a cleaning blade is used for a cylindrical toner image bearing member, a problem such that the cleaning blade is slantingly set (i.e., set so as not to be parallel to the axis of the toner image bearing member) occurs. In this case, the pressure of the cleaning blade at the side ends of the toner image bearing member is relatively low compared to that at the central portion of the toner image bearing member, thereby causing a problem in that toner particles on both side ends of the toner image bearing member are not well removed therefrom.

This defective cleaning due to positional variations of the set cleaning blade will be explained in detail using a drawing.

FIGS. 1A and 1B are views illustrating a cleaning blade which is set at a wrong position relative to a toner image bearing member due to positional variations of the blade. Referring to FIGS. 1A and 1B, an elastic blade 2 serving as a cleaning blade is set so as to be slanted at an angle of dθ relative to the axis of a photoreceptor 1 serving as an image bearing member. FIG. 1A is a schematic front view and FIG. 1B is a schematic side view. In FIG. 1A, the angle dθ is about 10 degree, but in reality the angle is much lower than 10 degree.

When positioning of the blade 2 is performed on the basis of a central portion 2*c* of the blade while the blade 2 is slanted at an angle of dθ, the tip of an end portion 2*e* of the blade 2 is apart from the surface of the photoreceptor 1 by a distance dL as illustrated in FIG. 1B. If the thus set blade 2 is pressure-contacted with the photoreceptor 1, the pressing strength of the end portion 2*e* at which the end portion 2*e* presses the surface of the photoreceptor 1 is lower than that of the central portion 2*c* because the degree of deformation of the tip of the end portion 2*e* pressed by the photoreceptor is smaller than that of the tip of the central portion 2*c*. Since the pressing strength of the end portion 2*e* is relatively low (i.e., the pressure of the end portion 2*e* is low), toner particles on the photoreceptor 1 tend to pass through the nip between the tip of the end portion 2*e* and the surface of the photoreceptor 1, resulting in occurrence of defective cleaning.

In this regard, the area of the contact portion of the end portion 2*e*, which is contacted with the surface of the photoreceptor 1, is relatively small compared to that of the central portion 2*c*. Therefore, the pressure per unit area of the end portion 2*e* is considered to be almost the same as that of the central portion 2*c*. However, the degree of deformation of the tip of the end portion 2*e* is smaller than that of the central portion 2*c*, the pressure caused by elasticity of the blade is lower at the end portion 2*e* than that at the central portion 2*c*. Therefore, the pressure per unit area of the end portion 2*e* is lower than that of the central portion 2*c*, resulting in occurrence of defective cleaning.

As a result of the present inventors' experiment in which a blade is intentionally set to be slanting, it was found that the cleanability of the end portions of the blade deteriorates. Thus, the theory mentioned above was confirmed.

In the above example illustrated in FIG. 1, cleaning of a cylindrical photoreceptor using a blade is explained. However, the material to be cleaned is not limited to such a cylindrical material, and the same is true for belt-form materials (such as endless belt photoreceptors and intermediate transfer media) if the materials have a curvature.

Because of these reasons, a need exists for a blade cleaning device which has good cleanability even when the blade is set to be slanted.

SUMMARY OF THE INVENTION

As a first aspect of the present invention, a cleaning device is provided which includes an elastic blade whose tip is contacted with a surface of a rotated member to be cleaned in such a manner as to counter the rotated member to remove particles of a toner on the rotated member; and a holder configured to support the elastic blade. The nip formed by the tip of longitudinal end portions of the blade and the surface of the rotated member has a first nip width in a rotation direction of the rotated member, and the nip formed by a central portion of the blade and the surface of the rotated member has a second nip width which is greater than the first nip width.

As another aspect of the present invention, a process unit is provided which includes a rotating member to be cleaned; and a cleaning device configured to remove particles of a toner on the rotating member therefrom, wherein the cleaning device is the cleaning device mentioned above, and the process unit is detachably attached to an image forming apparatus.

As yet another aspect of the present invention, an image forming apparatus is provided which includes a latent image bearing member; a charger configured to charge the latent image bearing member; a latent image forming device configured to form an electrostatic latent image on the latent image bearing member; a developing device configured to develop the electrostatic latent image with a developer including a toner to form a toner image; a transfer device configured to transfer the toner image onto a receiving material; and a cleaning device configured to remove particles of the toner present on a rotating member (such as the latent image bearing member, a charging roller of the charger and an intermediate transfer medium of the transfer device), wherein the cleaning device is the cleaning device mentioned above.

These and other objects, features and advantages of the present invention will become apparent upon consideration of the following description of the preferred embodiments of the present invention taken in conjunction with the accompanying drawings.

DETAILED DESCRIPTION OF THE INVENTION

First Embodiment

Figure 2:
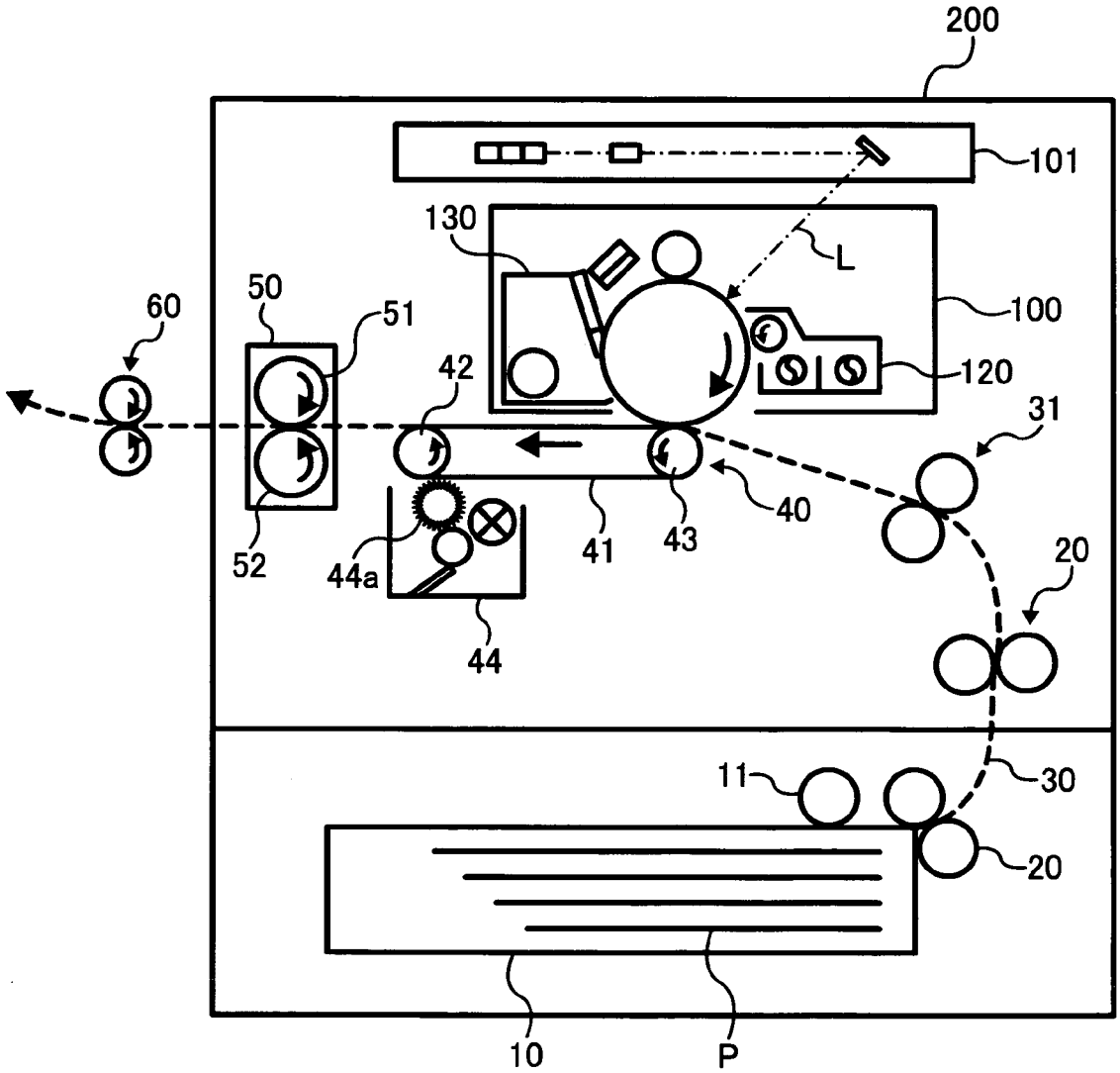
FIG. 2 is a schematic view illustrating an example (a printer) of the image forming apparatus of the present invention, which is used for First Embodiment.

FIG. 2 is a schematic view illustrating a printer, which is an example of the image forming apparatus of the present invention.

Referring to FIG. 2, a printer 200 includes a process unit 100, an optical image writing unit 101, a paper cassette 10, plural pairs of feeding rollers 20, a paper feeding passage 30, a pair of registration rollers 31, a transfer and feeding unit 40, a fixing unit 50 and a pair of discharging rollers 60.

The optical writing unit 101 includes a light source, a polygon mirror, an f-θ lens, a reflection mirror, etc., and irradiates a photoreceptor with laser light including image data to form an electrostatic latent image on the photoreceptor.

EXAMPLE 1

Figure 1A:
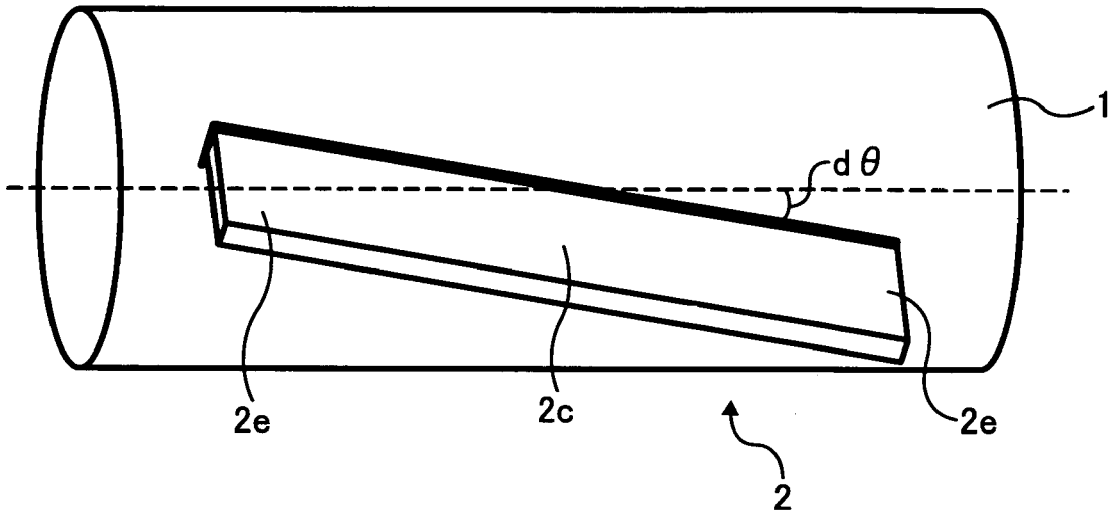
FIGS. 1A and 1B are schematic views for explaining a cleaning problem caused by a cleaning blade set to be slanted relative to a photoreceptor.
Figure 1B:
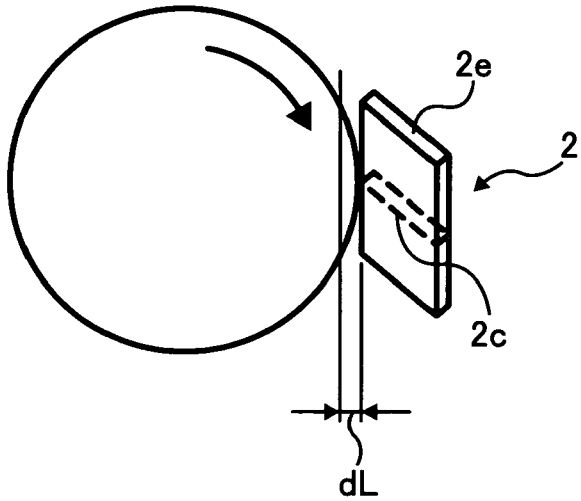
Figure 3:
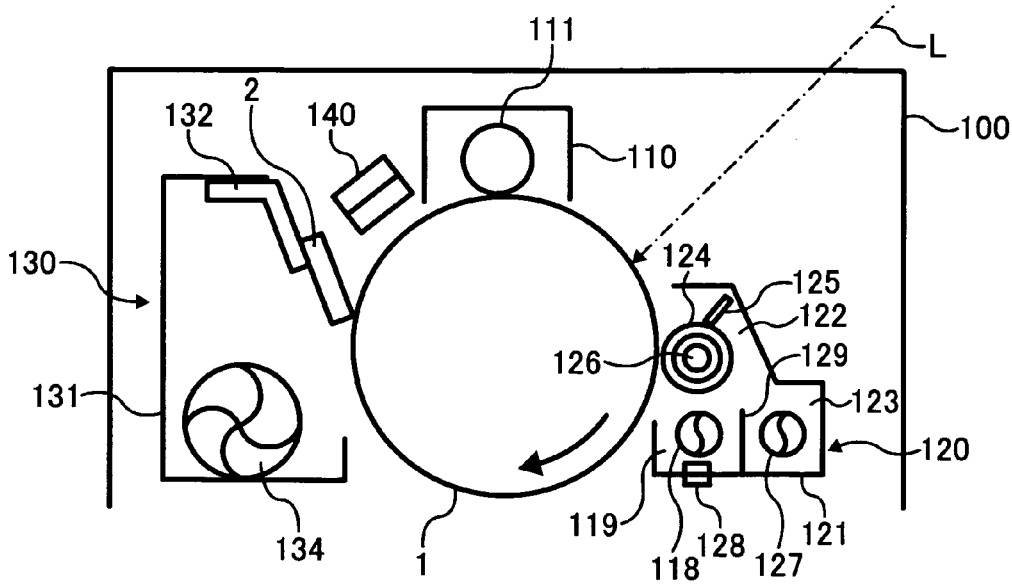
FIG. 3 is a schematic view illustrating an example of the process unit of the present invention, which is used for the image forming apparatus illustrated in FIG. 2.

FIG. 3 is a schematic view illustrating the process unit 100 illustrated in FIG. 1. The process unit 100 includes a drum-form photoreceptor 1, a charger 110, a developing device 120, a photoreceptor cleaning device 130, a discharger 140, etc.

The charger 110, which serves as charging means, includes a charging roller 111 which faces the photoreceptor 1 with a small gap therebetween while rotating and to which a bias is applied to charge the photoreceptor 1. Specifically, by applying a bias voltage to the charging roller 111, the charging roller 111 performs discharging on the photoreceptor 1, thereby uniformly charging the surface of the photoreceptor 1. The reason why the charging roller 111 is rotated is that a portion of the charging roller, which has just performed discharging at the smallest gap region (i.e., the discharging region) is escaped therefrom and another portion of the charging roller is entered into the discharging region to stably perform discharging on the photoreceptor 1.

Conventionally, chargers utilizing corona discharging (hereinafter corona chargers) have been used as the charging means for electrophotographic image forming apparatuses. One example of the corona chargers is a charger in which a charge wire is set so as to be close to a member to be charged. By applying a high voltage to the charge wire, corona discharging is caused between the charge wire and the member to be charged, thereby charging the member. However, such corona chargers have a disadvantage of producing a large amount of discharge-induced products such as ozone and nitrogen oxides (NOx). Since such discharge-induced products produce nitric acid and salts thereof, which adversely affect the properties of a photoreceptor, it is preferable to reduce the amount of such discharge-induced products.

In order to reduce the amount of discharge-induced products, contact chargers and short range chargers, which can charge a member with a relatively low electric energy, have been actively developed. In these chargers, a charging member such as rollers, brushes and blades is set so as to be contacted with or to be close to a member to be charged and a voltage is applied to the charging member to charge the surface of the member to be charged. Since these chargers have advantages in that the amount of discharge-induced products is relatively small compared to that in the case where a corona charging device is used; charging of a member can be performed with a low electric energy; and charging devices can be miniaturized, the chargers have good usefulness. However, contact chargers have a disadvantage in that toner particles remaining on the surface of a photoreceptor even after an image transfer operation are transferred to the contact charging member, resulting in occurrence of uneven charging (this problem is caused more frequently in a case where a spherical toner is used than in a case where a toner having irregular forms is used).

Another example of contact chargers is that an AC voltage is applied to a roller contacted with a member to be charged. When this contact charger is used, it is preferable to use an elastic roller so as not to apply a mechanical stress to the member to be charge. In this case, the width of the nip between the surface of the elastic roller and the surface of the member to be charged increases, and thereby a problem in that the materials included in the outermost layer of the member to be charged (such as protective layers of photoreceptors) are adhered to the elastic roller, resulting in occurrence of uneven charging tends to be caused.

By using a short range roller charger, occurrence of these problems can be prevented.

Therefore, the printer 200 uses a short range roller charger to uniformly charge the photoreceptor 1.

Figure 4:
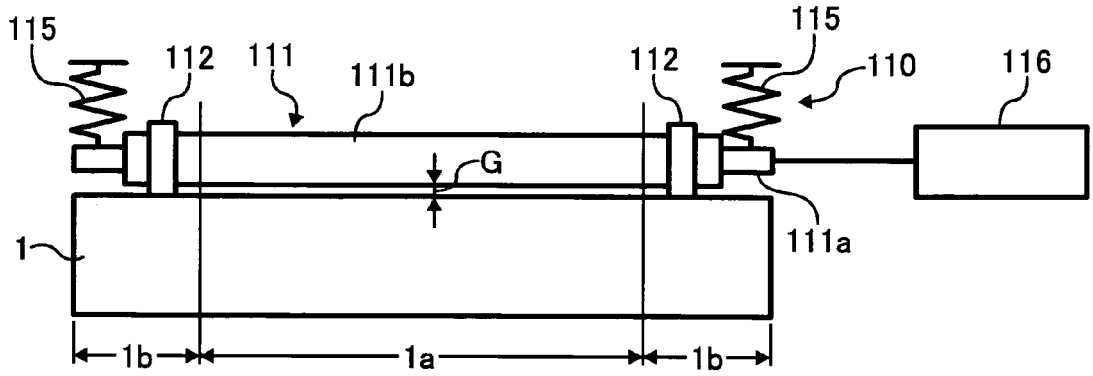
FIG. 4 is a schematic view illustrating the charger and photoreceptor of the process unit illustrated in FIG. 3.

FIG. 4 is an enlarged view illustrating the charger 110 and the photoreceptor 1. The charger 110 includes the charging roller 111, a spacer 112, a spring 115, and a power source 116. The charging roller 111 includes a shaft 111*a* and a roller portion 111*b* serving as a charging element. The roller portion 111*b* has a function of charging the surface of the photoreceptor 1, and is rotated by rotating the shaft 111*a*.

Since the spacer 112, which is provided at both end portions of the roller portion 111*b*, is contacted with the surface of a non-image forming region 1*b* of the photoreceptor 1, a small gap G is formed between the surface of the roller portion 111*b* and the surface of an image forming region 1*a* of the photoreceptor 1. The length of the roller portion 111*b* in the longitudinal direction of the roller is longer than that of the image forming portion 1*a* of the photoreceptor 1. Since the spacer 112 is contacted with the photoreceptor 1, the charging roller 111 is rotated while driven by the photoreceptor 1. The gap G is typically from 1 to 100 μm, and preferably from 30 to 65 μm. In this printer 200, the gap G is set to 50 μm.

The spring 115 is provided on both end portions of the shaft 111*a* to press the charging roller 111 toward the photoreceptor 1. Therefore, the gap can be precisely controlled to be the predetermined gap. The power source 116 is connected with the shaft 111*a* and applies an alternating voltage (i.e., a DC voltage overlapped with an AC voltage) thereto. Therefore, alternating discharging is caused and thereby the surface of the photoreceptor 1 is uniformly charged. By applying an alternating voltage, the surface of the photoreceptor 1 is uniformly charged so as to have a predetermined potential even when the gap G slightly varies.

The roller portion 111*b* includes a cylindrical electroconductive core shaft and a resistance controlling layer formed on the core shaft. In the printer 200, the roller portion 111*b* has a diameter of 10 mm.

The surface of the roller portion 111*b* can be constituted of a known material such as rubbers and resins, and is preferably constituted of a resin. When a rubber is used for the surface, a problem which often occurs is that the gap G is changed when the rubber is deformed by absorbing moisture in the air and/or by being pressed toward the photoreceptor 1. Depending on the image forming conditions, a problem in that only a central portion of the roller portion 111*b* is accidentally contacted with the surface of the photoreceptor 1, thereby damaging the surface of the photoreceptor occurs. Therefore, a hard material (such as resins) is preferably used for the surface of the roller portion 111*b* of the charging roller 111.

Specific examples of such hard materials for use in the resistance controlling layer include thermoplastic resin compositions in which an ion conduction type polymer is dispersed in a thermoplastic polymer such as polyethylene, polypropylene, polymethyl methacryalte, polystyrene and copolymers and mixtures thereof. The surface of the resistance controlling layer constituted of such a thermoplastic composition is preferably subjected a crosslinking treatment using a crosslinking agent. The crosslinking treatment can be performed by, for example, dipping the resistance controlling layer in a liquid including an isocyanate-containing compound. Alternatively, it is possible to form a crosslinked film on the resistance controlling layer.

Referring back to FIG. 2, the optical image writing unit 101 irradiates the surface of the charged photoreceptor 1 with laser light L after modulating and deflecting the laser light, and thereby potential of the lighted portions of the photoreceptor 1 is decreased, resulting in formation of an electrostatic latent image on the photoreceptor 1. The thus prepared electrostatic latent image is developed with a developer contained in the developing device 120 serving as developing means, resulting in formation of a toner image on the photoreceptor 1.

The photoreceptor 1 typically has a configuration such that a photosensitive layer including an organic photosensitive material is formed on a peripheral surface of a cylindrical substrate such as aluminum cylinders, and a protective layer having a charge transport function is optionally formed on the photosensitive layer. The shape of the photoreceptor is not limited to the drum form, and belt-form photoreceptors can also be used.

Referring to FIG. 3, the developing device 120 includes a casing 121, and a developing section 122, a developer supplying section 119, and a developer agitating section 123, which are contained in the casing 121. The developing section 122 includes a developing sleeve 124 which serves as a developer bearing member and a part of which is exposed from an opening of the casing 121, and a doctor blade 125.

The developing sleeve 124 has a cylindrical form and is made of a non-magnetic material. The surface of the developing sleeve 124 is subjected to a sand blasting treatment so as to have a rough surface, and therefore the surface has a good developer bearing ability. Alternatively, the developing sleeve 124 may have a surface having narrow grooves instead of rough surface. The developing sleeve 124 is rotated with driving means (not shown). Although a magnet roller 126 is set inside the developing sleeve 124, the magnet roller 126 is not driven by the developing sleeve 124. Since the magnet roller 126 has plural magnet poles which are separated from each other in the circumferential direction, magnetic fields are formed on the developing sleeve 124.

The developer supplying section 119 and the developer agitating section 123 contain a developer including a magnetic carrier and a negatively charged toner. The developer supplying section 119 includes a developer feeding screw 118 and a toner -concentration sensor 128. The developer agitating section 123 includes a developer agitating screw 127 and a toner replenishing portion (not shown).

The developer is fed by the feeding screw 118 in a direction of from the front side to the backside of FIG. 3 while agitated to be frictionally charged. When the developer is thus fed and agitated, the developer is contacted with the surface of the developing sleeve 124. Therefore, the developer is attracted by the developing sleeve 124 by means of the magnetic field which is formed by the magnetic roller 126 and which extends in a direction of from the surface of the developing sleeve 124 to the developer supplying section 119. Therefore, the developer is scooped up by the developing sleeve 124 from the developer supplying section 119 due to rotation of the developing sleeve 118, and is fed to a developer layer forming gap (hereinafter referred to as a doctor gap) at which the developing sleeve 118 faces the doctor blade 125. At the doctor gap, the developer on the surface of the developing sleeve 118 is scraped by doctor blade 125 to form a developer layer thereon while being further frictional charged thereat.

The developer passing through the doctor gap is fed to the developing region, at which the developing sleeve 124 faces the photoreceptor 1 with a predetermined gap (hereinafter referred to as a development gap), by the rotated developing sleeve 124. In the developing region, the developer on the surface of the developing sleeve 124 is erected due to the magnetic field formed by the magnet roller 126, resulting in formation of a magnetic brush. The magnetic brush moves in the developing region such that the tip thereof rubs the surface of the photoreceptor 1, and therefore the electrostatic latent image on the photoreceptor 1 is developed with a toner included in the magnetic brush, resulting in formation of a toner image on the photoreceptor.

The developer used for developing the electrostatic latent image is returned to the developing device 120 by the rotated developing sleeve 124. Then the developer is released from the surface of the developing sleeve 124 by means of repulsion magnetic field formed inside the developing device 120 and gravity thereof, and thereby the developer is returned to the developer supplying section 119, which is located below the developing section 122.

A partition 129 is provided between the developing supplying section 119 having the developer feeding screw 118 and the developer agitating section 123 having the agitating screw 127 to separate the developer supplying section 119 from the developer agitating section 123. In the developer supplying section 119, the feeding screw 118 is rotated with driving means (not shown) to supply the developer to the developing sleeve 124 while feeding the developer in the direction of from the front side to the backside of FIG. 3. The developer fed to the inner end of the developer supplying section 119 is transported to the developer agitating section 123 after passing through an opening (not shown) provided on the partition 129. The developer thus transported to the developer agitating section 123 is then fed in the direction of from the backside to the front side of FIG. 3. The developer is then returned to the developer supplying section 119 after passing through another opening provided on another end of the partition 119. Thus, the developer is circulated in the developing device 120 (i.e., in the developer supplying section 119 and the developer agitating section 123).

In this embodiment, the T sensor 128, which is a magnetic permeability sensor, is provided in the vicinity of the developer feeding screw 118. Magnetic permeability sensors output a voltage depending on the magnetic permeability of the developer fed by the developer feeding screw 118. Since the magnetic permeability of a developer is substantially proportional to the toner concentration of the developer, the voltage output from the T sensor 128 (i.e., a magnetic permeability sensor) is proportional to the toner concentration of the developer. The data of output voltage are sent to a controller (not shown). The controller includes a RAM which stores the target value $V_{tref}$ of the voltage output by the T sensor 128. The output voltage $V_{tref}$ is used for controlling driving of a toner supplying device (not shown). Specifically, when the voltage output from the T sensor is apart from the target value $V_{tref}$, the controller controls the toner supplying device so as to supply the toner in a toner replenishing section (not shown) to the developer agitating section 123 of the developing device 120 to approach the output voltage to the target value $V_{tref}$. By thus replenishing the toner, the concentration of the toner in the developer in the developing device 120 can be controlled to fall within the predetermined range.

Referring back to FIG. 2, the toner image formed on the photoreceptor 1 is then transferred onto a receiving material P (hereinafter referred to as a receiving paper sheet P), which is fed by a feeding belt 41 while borne on the surface of the feeding belt. Toner particles remaining on the surface of the photoreceptor 1 even after the image transfer operation are removed therefrom by the photoreceptor cleaning device 130.

The photoreceptor cleaning device 130 includes a casing 131, an elastic cleaning blade 2, a holder 132 configured to support the cleaning blade 2, and a collection screw 134. The holder 132 is made of a rigid material such as metals and hard plastics and one end (rear end) of the holder is fixed to the casing 131 (i.e., the holder is cantilevered). The holder 132 supports the cleaning blade 2 at a free end thereof as illustrated in FIG. 3.

The cleaning blade 2 which is fixed to the free end of the holder 132 is made of a soft material such as polyurethane rubbers. The free tip of the cleaning blade 2 is contacted with the surface of the photoreceptor 1 to scrape off toner particles on the surface of the photoreceptor 1. The toner particles thus scraped off fall on the collection screw 134.

The collection screw 134 is rotated by driving means (not shown) while receiving a positive cleaning bias from a power source (not shown). Therefore, the toner particles fall on the collection screw 134 are fed to a waste toner container (not shown) by rotation of the collection screw while electrostatically attracted by the collection screw.

The thus cleaned photoreceptor 1 is discharged with the discharging device 140. Thus, the photoreceptor 1 has an initial state, i.e., the photoreceptor is ready for charging with the charger 110 in the next image forming operation.

Referring back to FIG. 2, a cassette 10 containing a stack of the receiving paper sheets P is detachably set to the main body of the printer 200. By rotating a feeding roller 11 which is contacted with the surface of the uppermost receiving paper sheet P, the uppermost sheet is fed to the feeding passage 30. The feeding passage 30 includes plural pairs of feeding rollers 20 which are arranged at regular intervals, and the pair of registration rollers 31 which are provided at an end portion of the feeding passage 30. The uppermost sheet of the receiving paper sheets P is fed to the pair of registration rollers 31 by the plural pairs of feeding rollers 20 such that the tip of the sheet P is nipped with the pair of registration rollers. The registration rollers timely feed the sheet P such that the toner image on the photoreceptor 1 is transferred to a proper position of the sheet P at the transfer nip between the photoreceptor 1 and the transfer belt 41. The receiving paper sheet P bearing the toner image thereon is further fed by the transfer belt 41.

The transfer feeding unit 40 includes the feeding belt 41, a feeding belt driving roller 42, a bias roller 43, a feeding belt cleaning device 44, etc.

The feeding belt 41 includes a base layer, an elastic layer and an uppermost layer, wherein the base layer is contacted with the bias roller 43. The base layer is typically made of a fluorine-containing resin having a small extension coefficient, or a layer in which a material having a small extension coefficient such as cloths is included in a material having a large extension coefficient such as rubbers. Preferably, the base layer is a seamless film made of a resin such as polyvinylidene fluoride, polyimide, polycarbonate, and polyethylene terephthalate. The seamless resin film can include an electroconductive material such as carbon black to control the resistance (electroconductivity) thereof. The uppermost layer is preferably made of a material having a low surface energy (i.e., good toner releasability) such as fluorine-containing resins. The uppermost layer is typically prepared by coating a coating liquid including such a material on the base layer using a method such as spray coating methods and dip coating methods. The elastic layer is constituted of an elastic material such as fluorine-containing rubbers and acrylonitrile-butadiene rubbers to impart good elasticity to the belt.

The feeding belt 41 is tightly stretched by the feeding belt driving roller 42 and the transfer bias roller 43, and is rotated counterclockwise by the feeding belt driving roller 42, which is rotated by a belt driving motor (not shown). The transfer bias roller 43 is contacted with the base layer of the feeding belt 41 to apply a transfer bias thereto, wherein the transfer bias is applied to the transfer bias roller 43 by a power source (not shown). In addition, the transfer bias roller 43 presses the feeding belt 41 toward the photoreceptor 1, which rotates clockwise, to form a transfer nip therebetween. At the transfer nip, a transfer electric field is formed between the photoreceptor 1 and the transfer bias roller 43 due to the thus applied transfer bias.

The receiving paper sheet P, which has been fed by the pair of registration rollers 31, is fed into the transfer nip while borne on the upper surface of the feeding belt 41. At the transfer nip, the toner image on the photoreceptor 1 is transferred onto the receiving paper sheet P by means of the transfer electric field and the nip pressure.

The receiving paper sheet P, on which the toner image is transferred, is then fed into the fixing device 50 by the feeding belt 41. The feeding belt 41 typically has a small amount of toner particles on the surface thereof after feeding the receiving paper sheet P bearing the toner image thereon to the fixing device. Since the feeding belt 41 is rotated while sandwiched between the feeding belt driving roller 42 and the feeding belt cleaning device 44, the residual toner particles thereon are removed by the feeding belt cleaning device 44. In FIG. 2, the belt cleaning device 44 uses a rotating fur brush 44*a*, but is not limited thereto. For example, a cleaning device using a blade can also be used.

The fixing device 50 includes a fixing roller 51 containing a heat source (such as halogen lamps) therein and rotating in a direction indicated by an arrow, and a pressing roller 52 which applies a pressure to the fixing roller 51 and which rotates in a direction indicated by an arrow. The fixing roller 51 and the pressing roller 52 form a fixing nip therebetween. The receiving paper sheet P is fed into the fixing nip by the feeding belt 41 to be heated upon application of pressure, thereby fixing the toner image on the transfer paper sheet P. The receiving paper sheet P is then discharged from the main body of the printer 200 by the pair of discharge rollers 60. When another image is formed on the backside of the receiving paper sheet P, the sheet is fed to a reverse unit which is not shown but which is provided below the fixing device 50.

Next, conventional photoreceptor cleaning devices will be explained.

Figure 5:
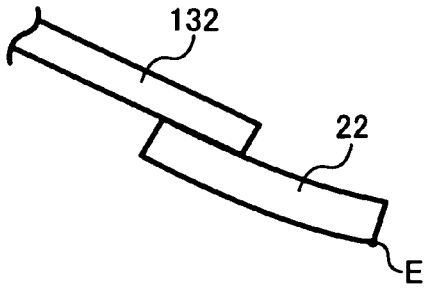
FIG. 5 BACKGROUND ART
FIG. 5 is a schematic view illustrating a conventional cleaning blade.

FIG. 5 illustrates a background cleaning device. The cleaning device includes the holder 132 and a cleaning blade 22. Similarly to the cleaning device illustrated in FIG. 3, one end of the holder 132 is fixed to a casing and therefore the holder is cantilevered. One end of the cleaning blade 22 is fixed to the free end of the holder 132 such that the blade 22 extends from the free end of the holder 132. The cleaning device is set such that an edge E of the tip of the blade 22 is contacted with the surface of the photoreceptor (not shown) to scrape off toner particles remaining on the surface of a photoreceptor. In order to improve the adherence of the blade 22 to a photoreceptor, it is preferable to use a soft material (such as polyurethane rubbers) for the blade 22. Since the blade 22 is pressed while the edge E is contacted with the surface of the photoreceptor, the free portion of the blade 22 is slightly bent as illustrated in FIG. 5. Particles of a pulverization toner which is prepared by a pulverization method and has irregular forms and which are present on the surface of the photoreceptor can be well removed therefrom by such a cleaning blade, but particles of a spherical toner cannot be well removed. The reason therefor is as follows.

Recently, a need exists for an electrophotographic image forming apparatus which can produce high quality images. In order to produce high quality images, it is preferable to use a spherical toner having a small particle diameter (hereinafter referred to as a small spherical toner). Therefore, toners which are prepared by polymerization methods and have a near-spherical form are typically used for electrophotographic image forming apparatuses. Since such spherical toners have such an advantage as to have a high transferability, the toners can produce images with good dot reproducibility. Therefore, such spherical toners can fulfill the above-mentioned requirement for high quality images.

However, spherical toners have a drawback in that toner particles thereof have poorer cleaning property than pulverization toners. Specifically, toner particles thereof cannot be well removed by cleaning blades which can be used for removing toner particles of pulverization toners. The reason therefor is considered to be that a rotation moment is formed on spherical toner particles present before the nip between a cleaning blade and a material to be cleaned, and therefore the toner particles push up the cleaning blade and easily enter into the nip, resulting in occurrence of defective cleaning. In order to prevent occurrence of such a cleaning problem, the conditions and precision of the blade contacted to the material to be cleaned have to be controlled more severely than in a case where a pulverization toner is used.

In addition, recently a need exists for a small-sized electrophotographic image forming apparatus, and therefore a need exists for a photoreceptor having a small diameter. When such a small photoreceptor is used, the conditions and precision of the blade contacted to the photoreceptor have to be controlled more severely. In other words, it becomes more difficult to well remove spherical toner particles remaining on the surface of a photoreceptor having a small diameter.

When spherical toner particles remaining on a photoreceptor having a small diameter are removed with a cleaning blade, it is preferable to increase the pressure applied to the cleaning blade to prevent the toner particles from entering the nip between the cleaning blade and the surface of the photoreceptor. In this case, the free portion of the cleaning blade is largely bent.

Figure 6:
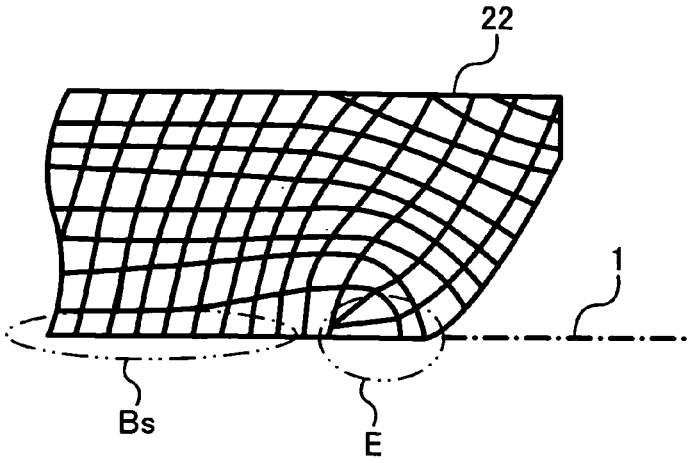
FIG. 6 BACKGROUND ART
FIG. 6 is a schematic enlarged view illustrating the tip of the cleaning blade illustrated in FIG. 5, which is pressed to such an extent as to be able to remove spherical toner particles prepared by a polymerization method.

FIG. 6 is an enlarged view illustrating the tip portion of a conventional cleaning blade which is pressed to a photoreceptor to an extent such that spherical toner particles remaining on the photoreceptor can be well removed by the blade. In FIG. 6, the photoreceptor moves in the direction indicated by an arrow. The edge E is deformed as illustrated by a circle E in FIG. 6. Specifically, the edge E is rolled up along the surface of the rotated photoreceptor 1, and hides under the tip portion of the blade 22. The portion indicated by a circle E has a length on the order of few micrometers in the rotation direction of the photoreceptor. The edge E achieves this rolled-up state even when the pressure is low to an extent such that spherical toners cannot be well removed but particles of a pulverization toner can be well removed. However, since the pressure applied to the blade is low in this case, a portion of the body indicated by a circle Bs is not contacted with the surface of the photoreceptor 1 unlike the blade illustrated in FIG. 6.

As illustrated in FIG. 6, a portion of the body indicated by the circle Bs is contacted with the surface of the photoreceptor 1 because the pressure applied to the blade 22 is strong and thereby the blade 22 is largely bent. When the blade achieves such a body-contact state, the friction between the blade 22 and the photoreceptor 1 seriously increases, resulting in occurrence of a problem in that the photoreceptor 1 is not smoothly rotated.

Figure 7:
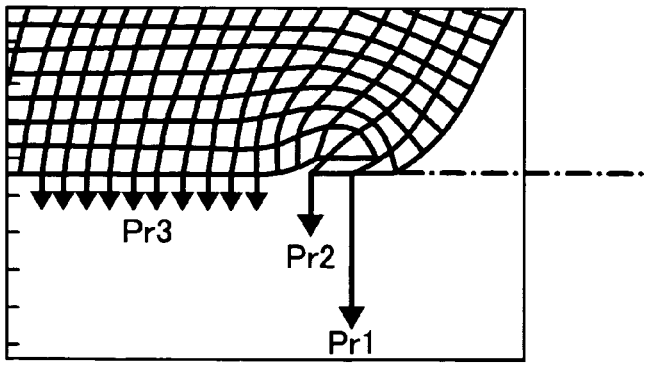
FIG. 7 BACKGROUND ART
FIG. 7 is a pressure distribution map of the tip of the cleaning blade illustrated in FIG. 5.

FIG. 7 is a view illustrating the pressure distribution in the tip portion of the blade 22. In FIG. 7, a portion having a longer arrow applied a greater pressure. By applying a pressure Pr1, which is highest among pressures Pr1, Pr2 and pr3, between the blade and the photoreceptor, spherical toner particles can be well removed. As mentioned above, when such a pressure (Pr1) is applied to a conventional cleaning blade to remove spherical toner particles on a photoreceptor, the blade achieves the body-contact state, and the problem in that the photoreceptor 1 is not smoothly rotated occurs.

Conventionally, whether or not the problem in that toner particles enter into the nip between the tip of a cleaning blade and the surface of a photoreceptor occurs is judged on the basis of the linear pressure (units of N/cm) of the blade. The linear pressure (LP) is obtained by the following equation:

$$LP(\text{N/cm})=\text{LOAD}/L$$

wherein LOAD represents the total load applied to the blade; and L represents the length of the edge E of the blade in the longitudinal direction thereof, which is contacted with the surface of the photoreceptor.

Specifically the linear pressure is determined as follows.

Figure 17:
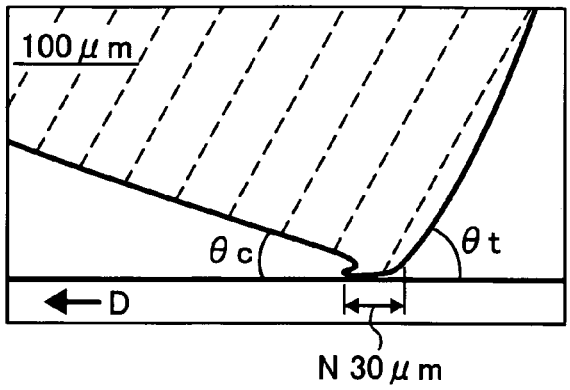
FIGS. 17-19 are schematic enlarged views illustrating the tips of the cleaning blades A, B and C.

At first, a blade is pressure-contacted with the surface of a photoreceptor such that the tip of the blade achieves a stick-state (for example, a state illustrated in FIG. 17). Next, a sheet-form sensor having a thickness of 0.1 mm is inserted into the nip between the blade and the photoreceptor to determine the load applied to the sensor. The linear pressure is determined by dividing the output of the sensor (i.e., the load applied to the sensor in units of gram) by the length of the contact portion of the blade in units of centimeter. The sheet-form sensor includes a two-dimensional array of electrodes, which is covered with a resin film. Each of the electrodes includes a pressure-sensitive material and a charge generation material which are arranged like a lattice. When a pressure is applied to an intersection of the lattice, the resistance of the pressure sensitive material changes depending on the pressure. When the resistance of the pressure sensitive material changes, the currents in the two-dimensional directions change. The total load applied to the sheet-form sensor is determined from the currents.

When the linear pressure is increased, spherical toner particles having a small particle diameter can be well removed. However, problems in that the photoreceptor and the cleaning blade are abraded at a high speed; and the torque applied to rotate the photoreceptor has to be increased occur.

In addition, as a result of the present inventors' study, it is found that whether or not the problem in that toner particles enter into the nip between the tip of a cleaning blade and the surface of a photoreceptor occurs cannot be judged on the basis of the linear pressure applied to the blade. As mentioned above, the linear pressure is determined by dividing the load applied to the contact portion of the blade by the length of the contact portion. However, in reality the contact portion is a nip (i.e., is not a line) and has an area. Therefore, even when the same load is applied to a blade, the area of the contact portion changes depending on the hardness of the material constituting the blade, the thickness of the blade, the length of the free portion of the blade, the shape of the blade, and other factors. Therefore, the real contact pressure is not necessarily the same as the linear pressure determined by the above-mentioned method. For example, even when the material constituting two blades is the same and the same load is applied to the two blades, the contact pressure applied to one of the blades is different from the other blade if the shape (of the tip) of the blades is different.

Figure 8:
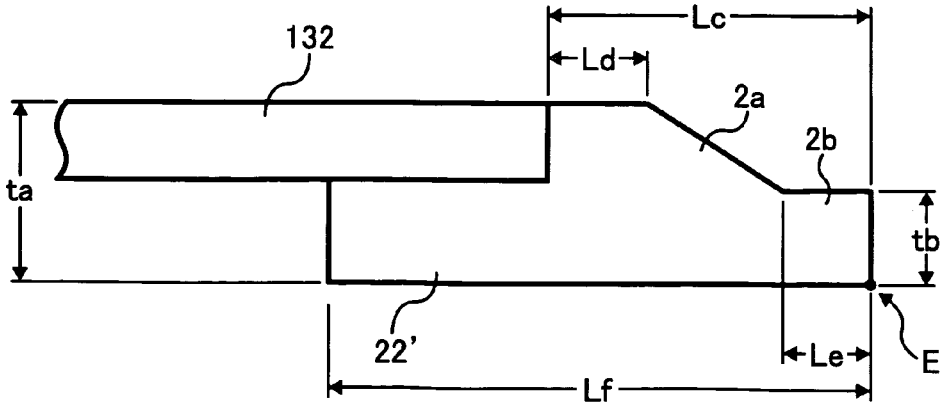
FIG. 8 BACKGROUND ART
FIG. 8 is a schematic view illustrating a cleaning blade having a thick portion.

FIG. 8 illustrates a background cleaning blade which has bending resistance greater than that of the cleaning blade illustrated in FIG. 5. In FIG. 8, the cleaning blade 22' has a thick portion 2*a*. The cleaning blade 22' is connected with the holder 132 in such a manner that the rear wall of the thick portion 2*a* is contacted with the front edge of the holder, and the backside of the holder is contacted with the surface of the rear portion of the blade. Thus, the blade 22' is connected with the holder 132 such that the front portion (i.e., free portion) of the blade, which includes the thick portion 2*a*, extends from the holder.

In the cleaning blade 22' illustrated in FIG. 8, the bending rate of the free portion of the blade 22' is lower than that in the case where the cleaning blade 22 illustrated in FIG. 5 is used. In addition, even when the free portion of the blade 22' is pressed, the free portion is not bent so easily because the back wall of the thick portion 2*a* is contacted with the holder 132.

Figure 9:
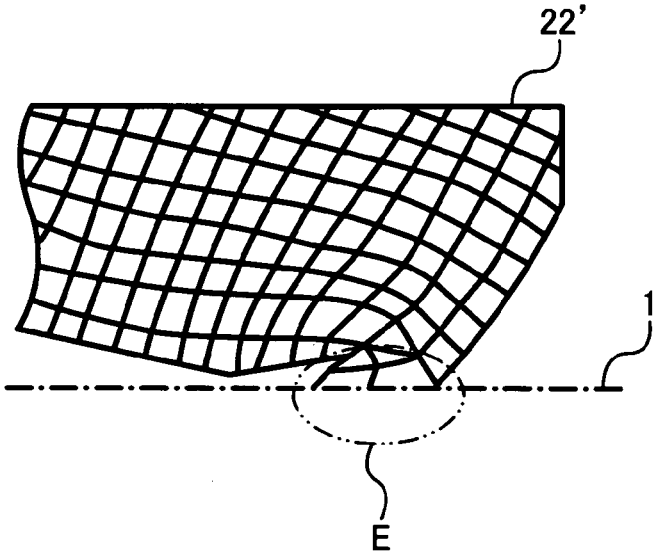
FIG. 9 BACKGROUND ART
FIG. 9 is a schematic enlarged view illustrating the tip of the cleaning blade illustrated in FIG. 8.
Figure 10:
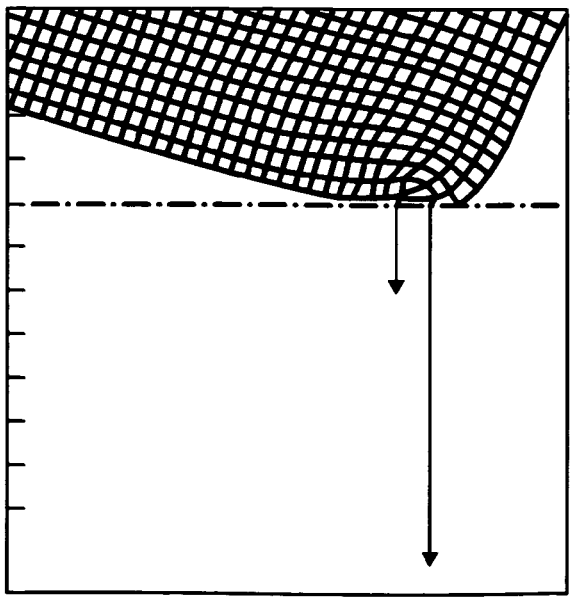
FIG. 10 BACKGROUND ART
FIG. 10 is a pressure distribution map of the tip of the cleaning blade illustrated in FIG. 8.

FIG. 9 is a view illustrating the cleaning blade which has the structure as illustrated in FIG. 8 and which is strongly pressed such that spherical toner particles can be well removed. Since the bending degree of the free portion of the blade 22' is decreased as mentioned above, the blade does not cause the body-contact problem mentioned above and only the edge E is contacted with the surface of the photoreceptor 1. The pressure distribution of the free portion of the blade 22' is illustrated in FIG. 10. It is clear from FIG. 10 that a high pressure is applied intensively to the edge E of the blade 22'. Since the cleaning blade 22' illustrated in FIG. 8 does not cause the body-contact problem, the load applied to the blade is intensively applied to the edge of the blade, and therefore the edge has a large pressure vector.

As mentioned above, the area of the contact portion of a blade with a photoreceptor changes depending on the shape of the blade, and thereby the pressure per unit area applied to the contact portion largely changes. Therefore, the cleanability of the cleaning blade also largely changes. In other words, the cleanability of a cleaning blade cannot be well evaluated by the linear pressure (having units of N/cm) applied thereto. Namely, when the pressure applied to a blade is increased while checking only the linear pressure, a problem in that spherical toner particles cannot be well removed or the photoreceptor is not smoothly rotated or is damaged can occur.

As a result of the present inventors' experiments, it is found that by checking the pressure per unit area (hereinafter sometimes referred to as the contact pressure) of a blade, the cleaning property of the blade can be well evaluated. The contact pressure is determined by dividing the load applied to a blade by the area of the contact portion between the tip of the blade and the surface of the photoreceptor. The contact area can be determined by observing the contact portion between a blade and a transparent pseudo photoreceptor (such as transparent drums), which is a substitute of a photoreceptor.

The experiments that the present inventors performed are as follows.

First Experiment

A cleaning blade having the structure as illustrated in FIG. 8 was contacted with a photoreceptor while the contact pressure is changed to determine the preferable contact pressure above which spherical toner particles on the photoreceptor can be well removed. The experimental conditions are as follows.

Diameter of photoreceptor: 30 mm

Linear velocity of he photoreceptor: 185 mm/s

Length of image forming region of the photoreceptor in the main scanning direction: 300 mm Length of photoreceptor (including non-image forming region) in the main scanning direction: 340 mm Thickness (tb) of the tip portion 2*b*: 1.7 mm Thickness (ta) of the thick portion 2*a*: 3.5 mm Length (Ld) of the thick portion 2*a*: 3.8 mm Length (Le) of the tip portion 2*b*: 1.2 mm Length (Lc) of the free portion: 7 mm Length (Lf) of the blade 2: 11 mm Thickness of the holder 132: 1.8 mm The cleaning property of a blade was evaluated as follows. Copies of a predetermined image were continuously produced using a printer. The printer was suddenly stopped and an adhesive tape was adhered to a surface of the photoreceptor, which surface was cleaned with the cleaning blade, to transfer toner particles remaining on the surface of the photoreceptor to the adhesive tape. The optical density of the tape bearing the residual toner particles thereon was measured with a densitometer. In this regard, the higher the optical density, the larger the amount of residual toner particles (i.e., the worse cleanability the blade has).

The pressure per unit area of the contact portion between the blade and the surface of the photoreceptor was determined as follows. The photoreceptor in the printer was replaced with a transparent glass tube (a pseudo photoreceptor) having the same diameter as the photoreceptor. The cleaning blade was contacted with the surface of the glass tube, and the load (F) per unit length of the blade in the axis direction of the glass tube was measured using a load measuring instrument (I-SCAN from Nitta Co., Ltd.). A video camera was set inside the glass tube to observe the contact portion of the blade with the surface of the glass tube, i.e., to determine the width (W) of the nip in the rotation direction of the photoreceptor (glass tube). The pressure per unit area of the contact portion was determined on the basis of the load (F) and the width (W).

Then the glass tube was replaced with the photoreceptor while the cleaning blade was set under the same conditions and copies of the predetermined image were produced. The toner used for forming images was a spherical toner prepared by a polymerization method.

The cleaning property of the blade was classified into the following four grades.

Category 5: Residual toner particles are clearly removed.

Category 4: A very small amount of toner particles remain on a surface of the photoreceptor after the cleaning operation.

Category 3: A small amount of toner particles remain on the entire surface of the photoreceptor after the cleaning operation, or a streak of toner particles remains on the entire surface of the photoreceptor after the cleaning operation.

Category 2: A large amount of toner particles remain on the entire surface of the photoreceptor after the cleaning operation, or a number of streaks of toner particles remain on the entire surface of the photoreceptor after the cleaning operation.

The results are shown in Table 1.

TABLE 1

| Linear pressure (N/cm) | Length of contact portion (μm) | Pressure per unit area (MPa) | Cleaning property (category) |
|---|---|---|---|
| 1.20 | 5 | 24.00 | 3 |
| 1.20 | 10 | 12.00 | 4 |
| 1.20 | 20 | 6.00 | 5 |
| 1.20 | 30 | 4.00 | 5 |
| 1.20 | 50 | 2.40 | 4 |
| 1.20 | 60 | 2.00 | 4 |
| 0.95 | 5 | 19.00 | 3 |
| 0.95 | 10 | 9.50 | 4 |
| 0.95 | 20 | 4.75 | 5 |
| 0.95 | 30 | 3.17 | 5 |
| 0.95 | 50 | 1.90 | 2 |
| 0.95 | 60 | 1.58 | 2 |
| 0.95 | 90 | 1.06 | 2 |
| 0.40 | 5 | 8.00 | 3 |
| 0.40 | 10 | 4.00 | 4 |
| 0.40 | 20 | 2.00 | 4 |
| 0.40 | 30 | 1.33 | 2 |
| 0.40 | 40 | 1.00 | 2 |
| 0.40 | 50 | 0.80 | 2 |
| 0.20 | 5 | 4.00 | 3 |
| 0.20 | 10 | 2.00 | 3 |
| 0.20 | 20 | 1.00 | 2 |

As illustrated in Table 1, the linear pressure was changed from 0.40 to 1.20 N/cm, and the nip width (W) was changed from 5 to 90 μm.

When the linear pressure is 1.20 N/cm, the blade had good cleanability (category 4 or 5) if the contact pressure is from 2.0 to 12 MPa. When the contact pressure is too high (24 MPa), defective cleaning occurred. The reason therefor is considered to be that since the contact width is too narrow (5 μm), the blade is unevenly contacted with the surface of the photoreceptor (i.e., some portions of the blade are contacted with the photoreceptor at a low pressure).

When the linear pressure is 0.95 N/cm, the blade had good cleanability (category 4 or 5) if the contact pressure is from 3.17 to 9.5 MPa. When the contact pressure is too high (19 MPa), defective cleaning occurred. The reason therefor is mentioned above. When the contact pressure is too low (not greater than 1.9 MPa), defective cleaning occurred due to low contact pressure.

When the linear pressure is 0.40 N/cm, the blade had good cleanability (category 4) if the contact pressure is from 2.0 to 4.0 MPa. When the contact pressure is too high (8 MPa), defective cleaning occurred due to uneven contact of the blade with the photoreceptor. When the contact pressure is too low (not greater than 1.33 MPa), defective cleaning occurred due to low contact pressure.

It is clear from Table 1 that when the contact pressure is controlled so as to be not less than 2.0 MPa, the cleaning blade has good cleanability (category 4 or 5) even when spherical toners are used. When the contact width is relatively small (about 10 μm) or the contact pressure is about 2.0 MPa, the cleaning blade has a cleanability of category 4. When the contact area is decreased, the contact pressure can be increased. However, when the contact width is excessively small, defective cleaning easily occurs due to uneven contact of the blade with the photoreceptor, scratches formed on the surface of the photoreceptor, projections on the surface of the photoreceptor, etc.

Therefore, in order to well remove spherical toner, the contact pressure of the blade is preferably not less than 2.0 MPa, and the contact width of the blade is preferably not less than 10 μm.

In order to prevent occurrence of abrasion of the surface of the photoreceptor and the blade used, and increase of torque for driving the photoreceptor, the contact width is preferably from 10 to 40 μm, and more preferably from 10 to 30 μm. When the contact width is too large (for example, on the order of 100 μm), the contact pressure of the blade has to be controlled so as to be not less than 2.0 MPa and preferably not less than 3.0 MPa to prevent residual toner particles from entering the nip between the blade and the surface of the photoreceptor. However, in order to apply a contact pressure of 2.0 MPa to a blade having a contact width of 100 μm, the linear pressure has to be increased to 2.0 N/cm, which is very large.

By applying such a high linear pressure to a blade, the blade is easily abraded. Therefore, it is preferable to control the contact pressure so as to be as low as possible as long as entering of residual spherical toner particles into the nip can be prevented. In order to prevent entering of residual spherical toner particles into the nip, the contact width of the blade is preferably from 10 to 40 μm, and more preferably from 10 to 30 μm, in consideration of variations in size of the photoreceptor set in the image forming apparatus and variations in particle diameter of the toner used. Namely, it is preferable to control the contact width and linear pressure so as to be from 10 to 40 μm, and from 0.20 to 1.20 N/cm, respectively, so that the contact pressure is not less than 2.0 MPa.

Next, the cleaning blade for use in the printer 200 will be explained.

FIGS. 11A-11E are schematic view illustrating an example of the cleaning device for use in the printer 200.

Figure 11A:
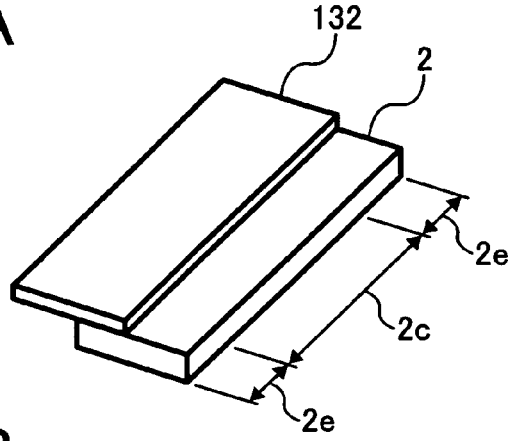
FIGS. 11A-11E are schematic views illustrating an example of the cleaning blade of the cleaning device of the present invention, which is used for First Embodiment.
Figure 11B:
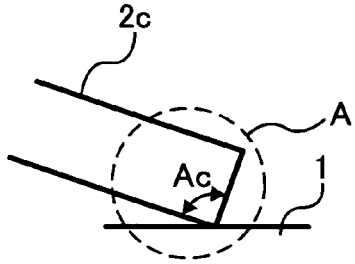
Figure 11C:
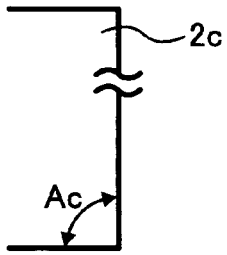
Figure 11D:
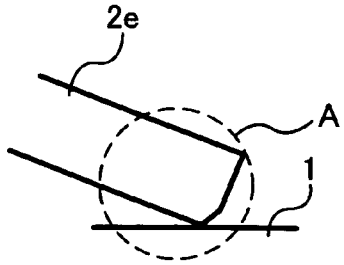

FIG. 11A is a perspective view illustrating the entire of the cleaning device. FIG. 11B illustrates a central portion 2*c* of the blade, which is contacted with the surface of the photoreceptor 1. FIG. 11C is an enlarged view of a portion A illustrated in FIG. 11B. FIG. 11D illustrates an end portion 2*e* of the blade, which is contacted with the surface of the photoreceptor 1. FIG. 11 E is an enlarged view of a portion A illustrated in FIG. 11D.

The cleaning device illustrated in FIG. 11A includes a holder 132 and an elastic blade 2 whose tip edge is contacted with the surface of the photoreceptor 1 (as illustrated in FIGS. 11B and 11D) and whose rear portion is adhered to the holder 132. The tip edge of the blade 2 is contacted with the non-image forming region of the photoreceptor as well as the image forming region thereof to remove toner particles remaining on the surface of the photoreceptor even after an image transferring process.

As illustrated in FIGS. 11B and 11D, the shape of the edge of the end portion 2*e* of the blade 2 is differentiated from that of the central portion 2*c* thereof to well remove toner particles remaining on the end portions of the photoreceptor.

Toner particles remaining on the end portions of a photoreceptor cannot be well removed by conventional cleaning blades. The reason therefor is as follows. As mentioned above referring to FIG. 1, when a cleaning blade is set so as to be slanted relative to the axis direction of the photoreceptor, the force of the end portion 2*e* by which the end portion 2*e* presses the surface of the photoreceptor is lower than that of the central portion 2*c* because the degree of deformation of the edge of the end portion 2*e* is smaller than that of the edge of the central portion 2*c*. Since the pressure of the end portion 2*e* is low, toner particles on the photoreceptor 1 tend to pass the nip between the edge of the end portion 2*e* and the surface of the photoreceptor 1, resulting in occurrence of defective cleaning. This problem is easily caused when the photoreceptor has a small diameter and the toner is a spherical toner having a small average particle diameter.

Figure 11E:
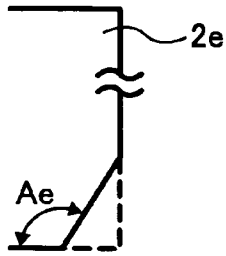

The cleaning device of the present invention hardly causes the cleaning problem mentioned above even when the linear pressure applied to the end portions of the blade is decreased due to, for example, positional variations of the cleaning device. Specifically, the shape of the edge of the end portion 2*e* of the blade 2 is differentiated from that of the central portion 2*c* thereof. In general, the tip edge of a blade has an angle (Ac) of about 90° in the central portion and the end portions. However, in the cleaning device of the present invention, the angle (Ae) of the end portions 2*e* is greater than that of the central portion 2*c* as illustrated in FIGS. 11C and 11E.

When the angle (Ae) of the end portions 2*e* is greater than that (Ac) of the central portion 2*c*, the end portions 2*e* of the blade can well remove residual toner particles (i.e., the end portions have the same cleanability as that of the central portion) even when the linear pressure applied to the end portions 2*e* is relatively low compared to that applied to the central portion 2*c*. The reason therefor will be explained referring to examples.

The relationship between the contact pressure of a blade and the cleanability thereof is mentioned above.

In Example 1, the angle (Ac) of the central portion 2*c* of the cleaning blade is 90°, and the angle (Ae) of the end portions 2*e* of the cleaning blade is 115°.

Figure 12:
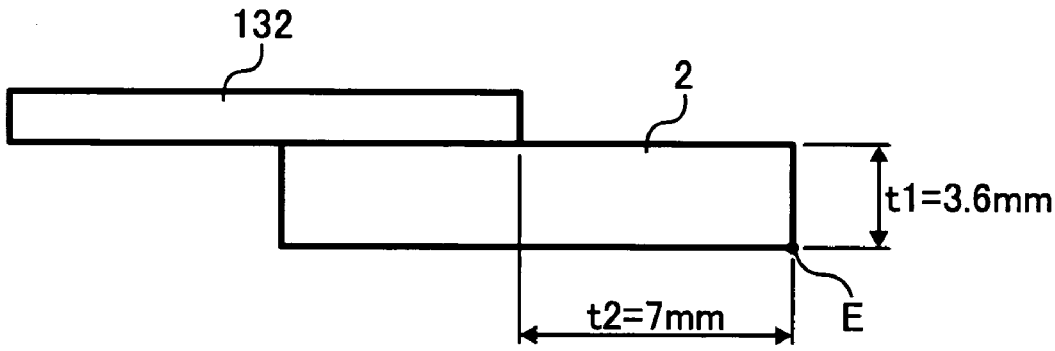
FIG. 12 is schematic view illustrating the cleaning blade used for cleaning a pulverization toner in Example 1.

FIG. 12 is a side view illustrating the cleaning device used in Example 1. In this cleaning device, an elastic rubber blade 2 is supported by a holder 132. The blade 2 has a thickness of 3.6 mm and the length of the free portion of the blade 2 is 7 mm. The blade 2 has a hardness of 70°, and the linear pressure applied to the cleaning blade 2 is 0.95 N/cm.

The edge of the central portion 2*c* is contacted with the surface of the photoreceptor while having a contact width (Wc) and the edge of the end portions 2*e* is contacted with the surface of the photoreceptor while having a contact width (We). The edge portions of the central portion 2*c* and the end portions 2*e* of the blade 2 contacted with the photoreceptor were observed to determine the contact widths (Wc and We). As a result, it was found that the contact widths Wc and We are about 30 μm and about 20 μm, respectively. This is because the angle (Ae) of the edge of the end portions 2*e* is greater than that (Ac) of the edge of the central portion 2*c*.

Since the contact pressure (pressure per unit area) of the blade can be determined by dividing the linear pressure (in units of N/cm) by the contact width (in units of μm), the contact pressure (Pe) of the end portions and the contact pressure (Pc) of the central portion are determined to be 3.17 MPa and 4.75 MPa, respectively.

As can be understood from Table 1, the contact pressure of a cleaning blade is preferably not less than 3.17 MPa. In order to apply such a contact pressure to the entire cleaning blade in the longitudinal direction thereof, the linear pressure (Fc) to be applied to the central portion 2*c* and the linear pressure (Fe) to be applied to the end portions 2*e* are as follows.

$$Fc=3.17(\text{MPa})\times 30(\mu\text{m})=0.95(\text{N/cm})$$

$$Fe=3.17(\text{MPa})\times 20(\mu\text{m})=0.634(\text{N/cm})$$

Thus, by using a blade such that the angle (Ae) of edge of the end portions 2*e* is greater than the angle (Ac) of edge of the central portion 2*c* (i.e., the contact area of edge of the end portions 2*e* is smaller than the contact area of edge of the central portion 2*c*), a contact pressure of not less than the preferable contact pressure (i.e., 3.17 MPa) can be applied to the edge of the end portions 2*e* even if the linear pressure at the edge of the end portions is lower by 0.316 N/cm (0.95-0.634) than that at the edge of the central portions.

Specifically, the cleaning blade 2 is preferably set such that a linear pressure of 0.95 N/cm is applied to the entire cleaning blade in the longitudinal direction thereof. If the real linear pressure applied to the end portions is lower than the linear pressure (0.95 N/cm) due to, for example, positional variations of the blade and photoreceptor used, the contact pressure applied to the edge of the end portions 2*e* is not less than the target pressure (3.17 MPa) provided that decrease of the linear pressure is not less than 0.316 N/cm. Thus, occurrence of the above-mentioned defective cleaning problem caused by variations of the blade and photoreceptor used can be prevented. In addition, even when the linear pressure is decreased after long repeated use of the blade, the chance of occurrence of the defective cleaning problem can be decreased.

When the angle of edge of the blade is greater than 90°, the degree of rolling-up of the edge becomes lower than that in the case where the angle is 90°. Therefore, it is advantageous because the contact pressure can be increased. In this regard, rolling-up is a phenomenon in that an edge is rolled up as illustrated in FIG. 17.

Figure 13:
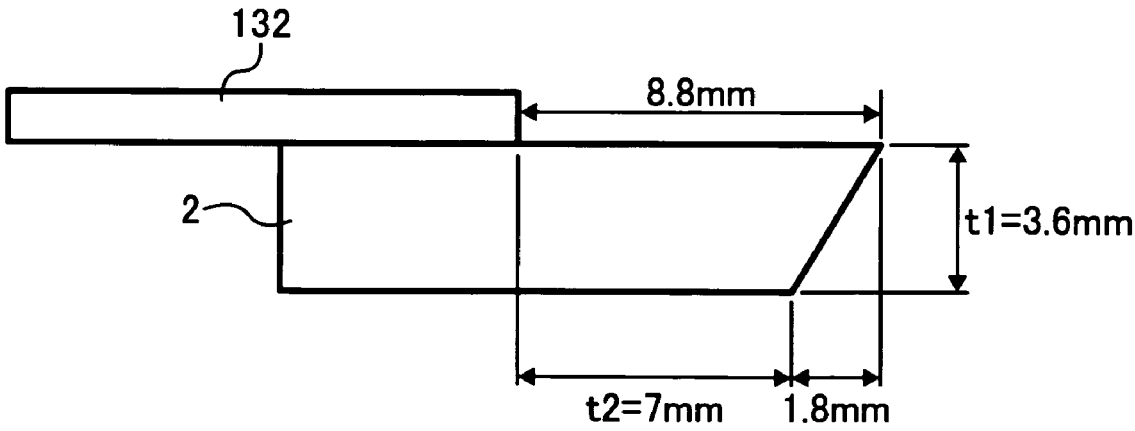
FIG. 13 is schematic view illustrating a cleaning blade which can be used for Examples 1.

In the blade illustrated in FIG. 11D, which is used for Example 1, only a portion of the tip is cut to form an edge having an obtuse angle. However, a cleaning blade which is illustrated in FIG. 13 and in which the entire tip is cut to form an edge having an obtuse angle can also be used.

Second Experiment

In the second experiment, the cleanabilities of blades whose tip portions have different shapes were compared.

Specifically, the second experiment was performed by using three blades which are made of the same material and whose tip portions have different shapes, to compare the conditions of the tip of the blades contacted with a photoreceptor and the areas of the tips of the blades.

The three blades A, B and C used for the second experiment have the same structure. FIG. 12 is the overview of the blades.

Figure 14:
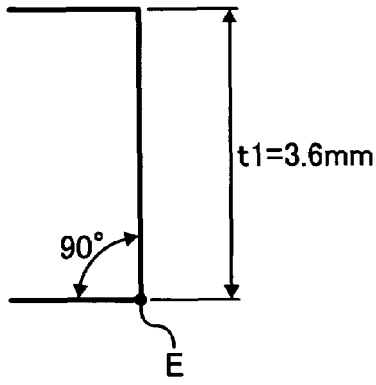
FIGS. 14-16 are schematic views illustrating the cleaning blades A, B and C used for Experiment 2.

The tip of the blade A is illustrated in FIG. 14. The angle of the edge E of the blade A to be contacted with a photoreceptor is 90°.

Figure 15:
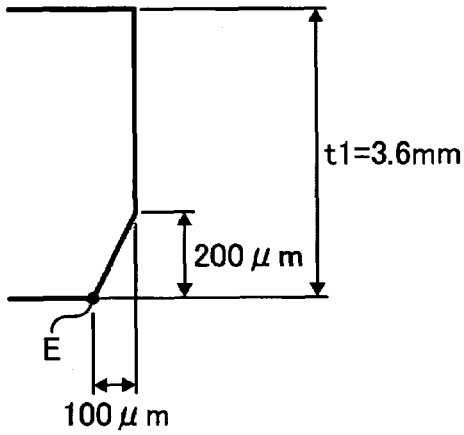

The tip of the blade B is illustrated in FIG. 15. The edge portion of the blade B to be contacted with a photoreceptor is cut by 100 μm in width and 200 μm in height as illustrated in FIG. 15 so that the edge E has an obtuse angle.

Figure 16:
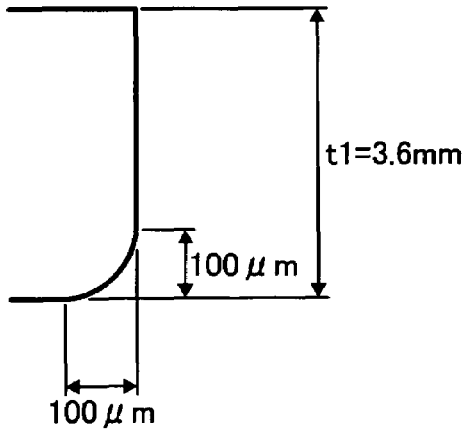

The edge portion of the blade C is illustrated in FIG. 16. The edge portion of the blade C to be contacted with a photoreceptor is rounded as illustrated in FIG. 16 so that the edge portion has a curvature of 100 μm.

These three blades A, B and C were contacted with the surface of a photoreceptor under the following contact conditions:

Linear pressure applied to the blades: 0.95 N/cm

Initial contact angle (i.e., an angle formed by lower surface of blade and tangent touching photoreceptor at contact point, i.e., θc in FIG. 17): 20°

Figure 18:
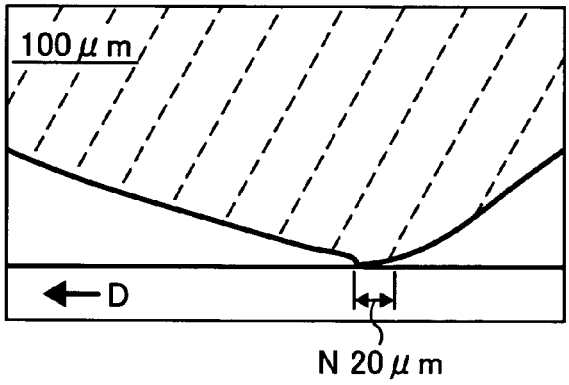
Figure 19:
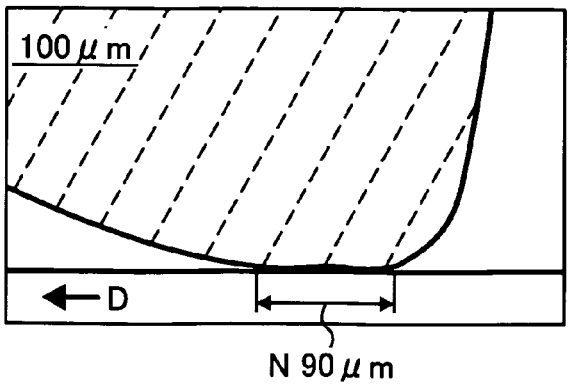

FIGS. 17, 18 and 19 are schematic views illustrating the three blades A, B and C which are contacted with the surface of a photoreceptor under the above-mentioned conditions. In FIGS. 17-19, characters D and N denote the rotation direction of the photoreceptor and the nip between the blade and the photoreceptor. The nip width of each of the three blades was determined by observing the nip by the method mentioned above. The results are shown in Table 2.

TABLE 2

| Blade | Nip width (μm) | Contact pressure (Pressure per unit area) (MPa) |
|---|---|---|
| A | 30 | 3.17 |
| B | 20 | 4.75 |
| C | 90 | 1.06 |

As illustrated in FIGS. 14 and 15, the blades A and B have an angulated edge. Therefore, when the blades are set on the surface of a photoreceptor, the edge portion is pulled by the rotated surface of the photoreceptor due to friction between the blades and the surface of the photoreceptor, thereby rolling up the edge portion at the nip N as illustrated in FIGS. 17 and 18. Since the load is concentrated to the rolled-up portion, entering of toner particles into the nip can be prevented.

In contrast, the blade C has a round edge as illustrated in FIG. 16, namely, the blade has no angulated edge. Therefore, when the blade C is contacted with the surface of a photoreceptor, the blade does not form a rolled-up portion and makes a body-contact with the photoreceptor as illustrated in FIG. 19. Therefore, the blade C has a large nip width. As shown in Table 2, the nip width of the blade C is 90 μm, and the contact pressure is 1.06 MPa, which is much lower than those for the blades A and B. Since the minimum contact pressure is about 2.0 MPa as mentioned above to well remove spherical toner particles, the blade C cannot well remove spherical toner particles on the surface of the photoreceptor.

As can be understood from FIGS. 17 and 18, the width N of the rolled-up portion of the blade B is shorter than the width (i.e., nip width) of the rolled-up portion of the blade A because the angle of the edge of the blade B is an obtuse angle, which is greater than the angle (90°) of the edge of the blade A.

As shown in Table 2, in the case of the blade A, the nip width is about 30 μm, and the contact pressure is 3.17 MPa whereas the nip width and the contact pressure are about 20 μm, and 4.75 MPa, respectively, in the case of the blade B. Thus, it is found that by forming an edge having an obtuse angle on the tip of a blade, a high pressure can be applied to the edge.

As mentioned above, when the tip of a blade has an angulated edge, a rolled-up portion can be formed on the edge portion because the edge portion is pulled by the surface of the rotated photoreceptor. Since a high pressure is concentrated to the rolled-up portion, a high pressure can be applied to the blade. In contrast, when the tip of a blade has a round edge (i.e., the blade C), a rolled-up portion is not formed. In this case, the area of the portion of the blade contacted with the surface of the photoreceptor is large, and therefore, the contact pressure applied to the tip of the blade is low.

EXAMPLE 2

Another example of the cleaning blade will be explained.

Figure 20A:
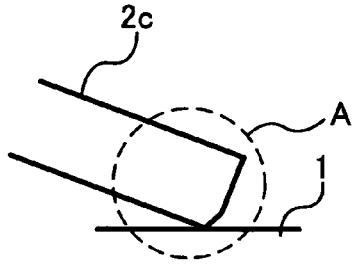
FIGS. 20A-20D are schematic views illustrating another example of the cleaning blade of the cleaning device of the present invention.
Figure 20B:
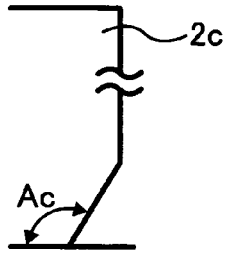
Figure 20C:
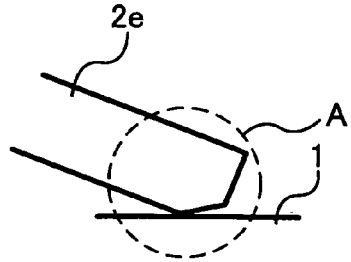
Figure 20D:
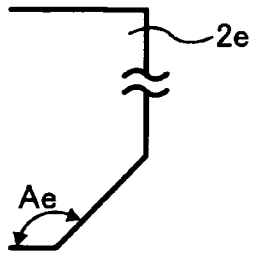

FIGS. 20A-20D are schematic views illustrating another example of the cleaning blade. FIG. 20A illustrates the tip portion of the central portion 2*c* of the blade 2, which is contacted with the photoreceptor 1. FIG. 20B is an enlarged view of the portion A of the central portion 2*c* in the longitudinal direction of the blade 2. FIG. 20C illustrates the tip portion of the end portions 2*e* in the longitudinal direction of the blade 2, which is contacted with the photoreceptor 1. FIG. 20D is an enlarged view of the portion A of the end portions 2*e* of the blade 2.

As can be understood from FIGS. 20B and 20D, each of the angle (Ac) of the edge of the central portion 2*c* and the angle (Ae) of the edge of the end portions 2*e*is an obtuse angle, wherein Ac<Ae.

The reason why the angle (Ac) is greater than 90° in this example is that when the edge has an obtuse angle, the linear pressure applied to the cleaning blade can be decreased because the contact area of the blade is small. When a high linear pressure is applied to a blade, the cleaning blade and the surface of the photoreceptor are easily abraded, and in addition the torque for driving the photoreceptor has to be increased. Therefore, it is preferable to decrease the linear pressure as much as possible in order to prolong the lives of the cleaning device, the photoreceptor and the process cartridge and image forming apparatus using the cleaning device and photoreceptor.

As mentioned above, when the edge has an obtuse angle, the area of the portion of the blade contacted with the surface of the photoreceptor is decreased. Therefore, even when a relatively low linear pressure is applied to such an edge of the blade, a contact pressure which is not less than that applied to an edge having an angle of 90° can be applied to the edge having an obtuse angle. Therefore, the blade can have good cleanability and can well remove residual toner particles.

In the cleaning blade in Example 2, the angle (Ac) of the edge of the central portion 2*c* is 115° and the angle (Ae) of the edge of the end portion 2*e* is 125°. Other properties of the cleaning blade are the same as those of the blade used in Example 1, and are the following.

Thickness of blade: 3.6 mm

Length of free portion of blade: 7 mm

Hardness of blade: 70°

Figure 21:
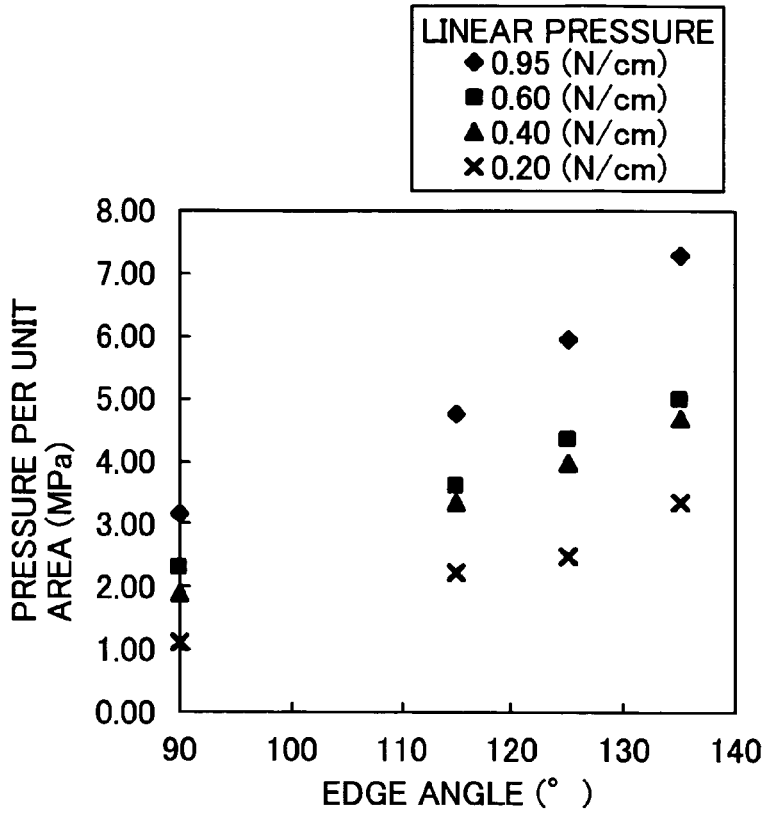
FIG. 21 is a graph illustrating the relationship between an angle of the tip edge of a cleaning blade and a pressure per unit area while changing the linear pressure applied to the tip edge.

FIG. 21 is a graph showing the relationship between a linear pressure applied to several blades having different edge angles and a contact pressure applied to the edges of the blades.

For example, when it is desired to apply a contact pressure of about 3.0 MPa to a blade whose central edge 2*c* has an angle of 90°, a linear pressure of 0.95 N/cm has to be applied to the entire blade. In contrast, in a case of a blade whose central edge 2*c* has an angle of 115°, a contact pressure of about 3.0 MPa can be obtained by applying a relatively low linear pressure of 0.40 N/cm to the blade. Namely, the linear pressure applied to the blade in Example 2 can be decreased by 0.55 N/cm compared to the linear pressure applied to the blade in Example 1.

In addition, since the angle of the edge of the end portions 2*e* is 125° in Example 2, a contact pressure of about 3.0 MPa can be obtained by applying a relatively low linear pressure of 0.30 N/cm to the end portions of the blade. Therefore, even when the linear pressure applied to the blade is decreased from 0.40 to 0.30 N/cm, a pressure per unit area of not less than 3.0 MPa can be applied to the entire portions of the blade of Example 2, and thereby occurrence of defective cleaning can be prevented.

The edge angles (i.e., 90°, 115° and 125°) of the central portion and end portions of the blades in Examples 1 and 2 are only examples and the edge angle is not limited thereto. Namely, the edge angles are preferably determined depending on the structure of the blade, the diameter of the photoreceptor used, the precision requirement for the contact pressure, etc. In addition, the border between the edge portion and the central portion of the blade does not necessarily face the border line between the image forming region and the non-image forming region of the photoreceptor. For example, the blade can be set such that the border faces a point of the image forming region or a point of the non-image forming region of the photoreceptor.

In addition, the edge angle is preferably continuously (or gradually) changed from the central portion toward the end portions. However, the edge angle can be suddenly changed at the border between the central portion and the end portion.

In Examples 1 and 2, the central portion and/or the end portions of the blades have an obtuse angle. This angle is preferably from 95° to 140°. When the angle is close to 90°, the contact area decreasing effect cannot be well produced.

In contrast, when the angle is too large, the following problem is easily caused. Since the initial contact angle (θc in FIG. 17) formed by the lower surface of the blade and the tangent touching the surface of the photoreceptor at the contact point is set so as to be from 15 to 30°, the angle (θt in FIG. 17) formed by the surface of the tip of the blade and the tangent touching the surface of the photoreceptor at the contact point is 10° if the edge angle is 140°. When the angle (θt) is too low, a problem in that toner particles are accumulated in the narrow space formed by the surface of the tip of the blade and the photoreceptor, thereby increasing the contact area of the blade, resulting in defective cleaning occurs.

In the cleaning device illustrated in FIGS. 12 and 13, it is preferable that the following relationship (1) is satisfied.

$$1.75 \leqq t2/t1 \leqq 3.00 \quad (1)$$

wherein t1 represents the thickness of the blade 2, and t2 represents the length of the free portion of the blade. When the cleaning device satisfies the relationship, occurrence of a bending problem in that the blade 2 is suddenly bent at the front edge of the holder 132 (i.e., the junction of the blade 2 and the holder 132 can be prevented.

Some conventional blades for use in cleaning a pulverized toner have a structure such that the length (t2) of the free portion of the blades is 8 mm and the thickness (t1) of the blades is 2 mm, wherein t2/t1=4. These blades easily cause the bending problem mentioned above, and thereby the body of the blades is contacted with the surface of the photoreceptor. Therefore, residual toner particles (particularly spherical toner particles) cannot be well removed. When a blade satisfies the above-mentioned relationship (1), occurrence of the bending problem can be prevented.

In the cleaning device of the present invention, the blade 2 is preferably made of a material having a JIS-A hardness of from 60° to 80°. When the hardness is too low, the bending problem can occur if relationship (1) is satisfied. In contrast, when the hardness is too high, the adherence of the blade with the surface of the photoreceptor deteriorates and thereby the contact pressure varies, resulting in occurrence of defective cleaning. When the contact pressure decreases, the linear pressure has to be increased to increase the contact pressure so as to be not less than 2.0 MPAa. When the linear pressure is excessively increased, the surface of the photoreceptor is easily abraded. Therefore, the hardness of the blade is preferably not less than 60°. In addition, the repulsion elasticity coefficient (defined in JIS K-6255) of the blade is preferably not greater than 30% at 23° C.

Defective cleaning occurring at an end portion of a cleaning blade is caused not only by positional variations of the set blade and photoreceptor but also by difference between the amounts of residual toner particles on the image forming region and non-image forming region of the photoreceptor. Specifically, since toner particles, which are present in the V-shaped space formed by the surface of the tip end of the blade and the surface of the photoreceptor, serve as a lubricant, the blade rubs the surface of the photoreceptor while the friction coefficient between the cleaning blade and the photoreceptor is decreased. In this case, a sufficient amount of toner particles to impart good lubricating property to the blade are supplied to the portion of the blade contacted with the image forming region of the photoreceptor but an insufficient amount of toner particles to impart good lubricating property to the blade are supplied to the portion of the blade contacted with the non-image forming region of the photoreceptor because only a part of the residual toner particles supplied to the portion of the blade contacted with the image forming region is transported to the portion of the blade contacted with the non-image forming region along the outer surface of the blade. In this case, a problem in that the entire tip portion (or the entire main body) of the blade is rolled up, occurs. This rolling-up phenomenon is different from the rolling-up of the edge portion of the tip portion as illustrated in FIGS. 17 and 18.

In attempting to solve this problem, JP-A 2002-258701 proposes a cleaning blade satisfying the following relationship:

$$R1 \leqq R2 \text{ (wherein } 0 \leqq R1 \leqq 100\ \mu m, \text{ and } 10\ \mu m \leqq R2)$$

wherein R1 represents the curvature of the edge of the central portion of the blade, which is contacted with the image forming region of the photoreceptor, and R2 represents the curvature of the edge of the end portions of the blade, which are contacted with the non-image forming regions.

However, as mentioned above in Second Experiment, if the edge of the blade is rounded, the contact area of the blade increases and thereby the contact pressure is decreased. Therefore, defective cleaning is easily caused.

In contrast, since the end portions of the blade of the present invention have an edge having an obtuse angle, the blade rolling-up problem in that the entire tip portion of the blade is rolled up is not caused although rolling-up of the edge of the end portions of the blade as illustrated in FIGS. 17 and 18 is caused. Thus, by using the cleaning blade of the present invention, decrease of the contact pressure per unit area can be prevented while occurrence of the blade rolling-up problem is also prevented.

Even when a sufficient amount of toner particles are supplied to the cleaning blade, the following cleaning problem can be caused. Specifically, since the friction between the end portions of the cleaning blade and the surface of the photoreceptor is greater than that between the center portion of the cleaning blade and the surface of the photoreceptor because the amount of residual toner particles is small at the end portions of the blade, the blade is unstably contacted with the surface of the photoreceptor in the longitudinal direction of the blade. In this case, not only the load applied to the edge of the end portions but also the load applied to the edge of a central portion of the blade near the end portions thereof are decreased, resulting occurrence of defective cleaning.

In the cleaning blades of Examples 1 and 2, the angle (Ac) of the edge of the central portion 2*c* thereof is differentiated from the angle (Ae) of the edge of the end portions 2*e* thereof, and therefore occurrence of variation of the contact pressure in the central portion 2*c* and the end portions 2*e* can be prevented. Therefore, stable cleaning operation can be performed.

The material constituting the blade 2 preferably has a repulsion elasticity coefficient (defined in JIS K-6255) of not greater than 30%. One of the reasons therefor is that when the material has such a repulsion elasticity coefficient, the tip of the blade causes little vibration, and thereby even spherical toner particles can be well removed by the blade. The other of the reasons is that when the material has such a repulsion elasticity coefficient, the abrasion loss of the tip of the blade is small. Thus, by using a blade made of a material having such a repulsion elasticity coefficient, occurrence of defective cleaning due to vibration of the tip portion of the blade can be prevented.

When a conventional cleaning blade is used for removing a toner prepared by a pulverization method, the tip of the cleaning blade dashes off residual toner particles to remove the toner particles. Cleaning blades having a low repulsion elasticity coefficient do not have this dash-off effect. However, recently spherical toners are mainly used for electrophotographic image forming apparatuses. Spherical toners are not dashed off by a blade and enter into the nip between the blade and the surface of the photoreceptor. Namely, cleaning blades cannot dash off spherical toner particles. In addition, when a blade having a high repulsion elasticity coefficient is used for removing spherical toner particles, the toner particles pass through the nip relatively easily compared to the case where a blade having a low repulsion elasticity coefficient is used because the blade having a high repulsion elasticity coefficient causes micro-vibration.

Further, it is well known that blades having a low repulsion elasticity coefficient have an advantage such that the abrasion loss of the blades is little. Specifically, a cleaning blade is gradually abraded by being rubbed by the photoreceptor when repeated used for image forming operations. As a result of the present inventors' study for the abrasion, it is found that the tip portion of the blade which is constituted of a polymer (such as polyurethane rubbers) is torn due to the stick-slip movement of the blade, resulting in occurrence of fatigue fracture, and thereby the tip portion of the blade is abraded. In this case, the tip portion of the blade is torn, and the portion cause defective cleaning.

In contrast, when a blade having a low repulsion elasticity coefficient is used, the number of stick-slip movements of the blade is much smaller than that of a blade having a high repulsion elasticity coefficient. Therefore, the tip of the blade having a low repulsion elasticity coefficient hardly causes the tearing problem even after long repeated use. Therefore, the blade is hardly abraded, and can maintain good cleanability for a long period of time.

As mentioned above, in order to well remove spherical toner particles, a relatively high contact pressure has to be applied to a blade compared to the case where the blade is used for removing a pulverization toner. When the contact pressure applied to a blade is increased, the surface of the photoreceptor cleaned by the blade is also easily abraded.

Figure 22:
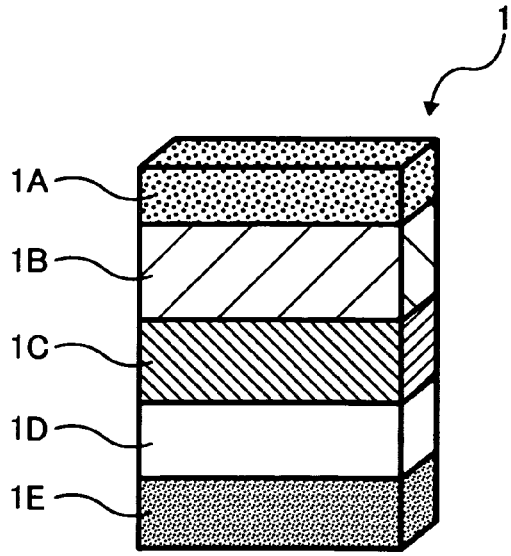
FIG. 22 is a schematic view illustrating the cross section of a photoreceptor for use in the image forming apparatus of the present invention.

Therefore, the photoreceptor 1 (which is negative-charge organic Photorecep tor) of the present invention has a special layer as an outermost layer. FIG. 22 is a schematic view illustrating the cross-section of the photoreceptor 1. The photoreceptor illustrated in FIG. 22 includes a drum-form electroconductive substrate 1E having a diameter of 30 mm and a photosensitive layer and other layers which are overlaid on the substrate.

Specifically, an undercoat layer 1D is formed on the electroconductive substrate 1E, and a photosensitive layer including a charge generation layer (CGL) 1C and a charge transport layer (CTL) 1B is formed thereon. In addition, a protective layer (FR) 1A is formed thereon as an outermost layer.

Suitable materials for use in the electroconductive substrate include materials having a volume resistivity of not greater than $10^{10}$ Ω·cm. Specific examples of such materials include film-form or cylindrical plastics and papers, on the surface of which is covered with a metal such as aluminum, nickel, chromium, nichrome, copper, gold, silver, platinum and the like, or a metal oxide such as tin oxides, indium oxides and the like, by deposition or sputtering. In addition, a plate of a metal such as aluminum, aluminum alloys, nickel and stainless steel can be used. A metal cylinder can also be used as the substrate, which is prepared by tubing such a metal as mentioned above by a method such as impact ironing or direct ironing, and then treating the surface of the tube by cutting, super finishing, polishing and the like treatments. Further, endless belts of a metal such as nickel and stainless steel can also be used as the electroconductive substrate.

Furthermore, substrates, in which a coating liquid in which an electroconductive powder is dispersed in a binder resin is coated on the electroconductive supports mentioned above, can be used as the substrate. Specific examples of such an electroconductive powder include carbon black, acetylene black, powders of metals such as aluminum, nickel, iron, nichrome, copper, zinc and silver, and metal oxides such as electroconductive tin oxides and ITO. Specific examples of the binder resin used in combination therewith include known thermoplastic resins, thermosetting resins and photocrosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, and alkyd resins.

Such an electroconductive layer can be formed by coating a coating liquid in which an electroconductive powder and a binder resin are dispersed in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON) with an electroconductive material, can also be used as the substrate for us in the present invention.

The charge generation layer (CGL) includes a charge generation material (CGM) as a main component. Known charge generation materials can be used for the CGL. Specific examples of such CGMs include azo pigments such as monoazo pigments, disazo pigments, asymmetric disazo pigments and trisazo pigments; phthalocyanine pigments such as titanyl phthalocyanine, copper phthalocyanine, vanadyl phthalocyanine, hydroxygallium phthalocyanine and metal free phthalocyanine; perylene pigments, perynone pigments, indigo pigments, pyrrolopyrrole pigments, anthraquinone pigments, quinacridone pigments, quinone type condensed polycyclic compounds, squaric acid type dyes, and the like pigments and dyes. These CGMs can be used alone or in combination.

Suitable binder resins, which are optionally mixed in the CGL coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The content of the binder resin in CGL is preferably from 0 to 500 parts by weight, and preferably from 10 to 300 parts by weight, per 100 parts by weight of the CGM included in the CGL.

The CGL can be prepared, for example, by the following method:

(1) a CGM is mixed with a proper solvent optionally together with a binder resin;
(2) the mixture is dispersed using a ball mill, an attritor, a sand mill or a supersonic dispersing machine to prepare a coating liquid; and
(3) the coating liquid is coated on an electroconductive substrate or the undercoat layer and then dried to form a CGL.

A binder resin can be mixed before or after the dispersion process.

Suitable solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. These solvents can be used alone or in combination.

The CGL coating liquid includes a CGM, a solvent and a binder resin as main components, but can include additives such as sensitizers, dispersants, surfactants and silicone oils.

The CGL coating liquid can be coated by a coating method such as dip coating, spray coating, bead coating, nozzle coating, spinner coating and ring coating methods. The thickness of the CGL is preferably from 0.01 to 5 μm, and more preferably from 0.1 to 2μm.

The charge transport layer (CTL) can be formed, for example, by the following method:

(1) a charge transport material (CTM) and a binder resin are dispersed or dissolved in a proper solvent to prepare a CTL coating liquid; and
(2) the coating liquid is coated on the CGL and dried to form a CTL.

The CTL coating liquid can include one or more additives such as plasticizers, leveling agents, antioxidants and the like, if desired.

CTMs are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These CTMs can be used alone or in combination.

Specific examples of the binder resin for use in the CTL include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the CTM in the CTL is preferably from 20 to 300 parts by weight, and more preferably from 40 to 150 parts by weight, per 100 parts by weight of the binder resin included in the CTL. The thickness of the CTL is preferably not greater than 25 μm in view of resolution of the resultant images and response (i.e., photosensitivity) of the resultant photoreceptor. In addition, the thickness of the CTL is preferably not less than 5 μm so that the resultant photoreceptor has a proper charge potential. The lower limit of the thickness changes depending on the image forming system for which the photoreceptor is used.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The photosensitive layer can be a single-layered photosensitive layer. Such a single-layered photosensitive layer can be formed by coating a coating liquid in which a CGM, a CTL and a binder resin are dissolved or dispersed in a proper solvent, on the electroconductive substrate or the undercoat layer, and then drying the coated liquid. As the CGM and CTM, the CGMs and CTLs mentioned above for use in the CGL and CTL can be used.

Suitable binder resins for use in the photosensitive layer include the resins mentioned above for use in the CTL. The resins mentioned above for use in the CGL can be added as a binder resin. In addition, the charge transport polymer materials can also be used as a binder resin.

The content of the CGM is preferably from 5 to 40 parts by weight, and more preferably from 10 to 30 parts by weight, per 100 parts by weight of the binder resin included in the photosensitive layer. The content of the CTM is preferably from 0 to 190 parts, and more preferably from 50 to 150 parts by weight, per 100 parts by weight of the binder resin included in the photosensitive layer.

The single-layered photosensitive layer can be formed by coating a coating liquid in which a CGM, a binder and a CTM are dissolved or dispersed in a solvent such as tetrahydrofuran, dioxane, dichloroethane, cyclohexane, toluene, methyl ethyl ketone and acetone by a coating method such as dip coating, spray coating, bead coating and ring coating.

The photosensitive layer coating liquid may include additives such as plasticizers, leveling agents, antioxidants and lubricants. The thickness of the photosensitive layer is preferably from about 5 to about 25 μm.

The undercoat layer typically includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moiré in the resultant images and to decrease residual potential of the resultant photoreceptor.

The undercoat layer can also be formed by coating a coating liquid using a proper solvent and a proper coating method mentioned above for use in the photosensitive layer.

The undercoat layer can be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer.

The thickness of the undercoat layer is preferably 0 to 5 μm.

The protective layer 1*a* is formed to improve the abrasion resistance of the photoreceptor and can be prepared by, for example, forming an amorphous silicon layer or a layer in which an alumina or a tin oxide is dispersed.

The structure of the photoreceptor is not limited to those mentioned above. For example, photoreceptors having a structure such that only a photosensitive layer including a CGM and a CTM as main components is formed on an electroconductive substrate; or a CGL and a CTL are overlaid on an electroconductive substrate can also be used. In addition, a protective layer can be formed on these photoreceptors. Further, a photoreceptor having a structure in that a CTL, a CGL and a protective layer are overlaid on an electroconductive substrate can also be used.

The protective layer preferably includes a crosslinked binder resin. Such a crosslinked structure is preferably formed by crosslinking a material including a reactive monomer having a plurality of crosslinking functional groups in a molecule using heat energy and/or light energy to form a three-dimensional network structure. The thus prepared three-dimensional network structure serves as a binder, and thereby good abrasion resistance can be imparted to the resultant photoreceptor.

In order to impart a good combination of electric stability, and abrasion resistance (i.e., long life) to the photoreceptor, it is preferable to use a monomer having a charge transport structure as the reactive monomer or a part of the reactive monomer. By using such a monomer, the resultant network structure includes a charge transport moiety. Therefore, the protective layer has a good combination of a charge transport function and a abrasion resistance.

Suitable reactive monomers having a charge transport structure for use in forming the protective layer include compounds having both at least one charge transport group and at least one silicon atom having a hydrolyzable substituent in a molecule; compounds having both at least one charge transport group and at least one hydroxyl group; compounds having both at least one charge transport group and at least one carboxyl group; compounds having both at least one charge transport group and at least one epoxy group; and compounds having both at least one charge transport group and at least one isocyanate group. These monomers can be used alone or in combination. Particularly, reactive monomers having a triarylamine structure as the charge transport group are more preferably used because of having a good combination of electric stability, chemical stability and carrier mobility.

In addition, in order to reduce the viscosity of the coating liquid, to relax the stress of the crosslinked protective layer, and to impart functions such as low surface energy and friction coefficient to the protective layer, known radically polymerizable mono- or di-functional monomers and radically polymerizable oligomers can be used in combination with polymerizable monomers.

Specific examples of such radically polymerizable mono- or di-functional monomers include known mono- or di-functional monomers.

Crosslinking a reactive monomer is preferably performed using heat energy or light energy. When heat energy is used, a polymerization initiator is preferably used to perform a crosslinking reaction at a low temperature.

When light energy is used, ultraviolet light is preferably used. A photo-polymerization initiator is typically used to smoothly perform the photo-crosslinking reaction. Suitable materials for use as the photo-polymerization initiator include compounds which absorb ultraviolet rays having a wavelength of not greater than 400 nm and generate active species such as radicals and ions to induce a polymerization reaction.

It is possible to use heat energy and light energy for performing the crosslinking reaction while using both a heat polymerization initiator and a photo-polymerization initiator.

The thus prepared protective layer has good abrasion resistance. However, if the protective layer is too thick, a problem in that the protective layer cracks due to large shrinkage in the crosslinking reaction occurs. In order to prevent occurrence of such a problem, a layered protective layer in which a crosslinked protective layer is formed on a protective layer including a non-crosslinked polymer and a low molecular weight charge transport material can be preferably used.

One preferred example of the protective layer for use in the photoreceptor used for the image forming apparatus of the present invention is as follows.

At first, the following components are mixed to prepare a protective layer coating liquid.

| | |
|---|---|
| Methyltrimethoxysilane | 182 parts by weight |
| Dihydroxymethyltriphenylamine | 40 parts by weight |
| 2-propanol | 225 parts by weight |
| 2% acetic acid | 106 parts by weight |
| Aluminum trisacetylacetate | 1 part by weight |

The coating liquid is coated on a CTL (or a photosensitive layer). The coated liquid is dried and the layer is subjected to a crosslinking reaction for one hour at 110° C. Thus, a protective layer having a thickness of 3 μm is prepared.

Another preferred example of the protective layer is as follows. At first, 30 parts by weight of a positive charge transport material having the below-mentioned formula (I) and 0.6 parts by weight of a mixture of an acrylic monomer having the below-mentioned formula (II) and a photo-polymerization initiator (1-hydroxy-cyclohexyl phenyl ketone) are dissolved in a mixture solvent of 50 parts by weight of monochlorobenzene and 50 parts by weight of dichloromethane to prepare a protective layer coating liquid. The coating liquid is coated on a charge transport layer using a spray coating method. The coated liquid is exposed to light, which is emitted by a metal halide lamp and has a light intensity of 500 mW/cm$^2$, for 30 seconds to perform a crosslinking reaction. Thus, a protective layer having a thickness of 5 μm is prepared.

(I)

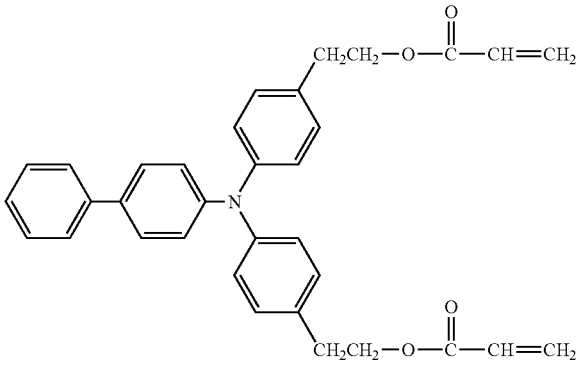

(II)

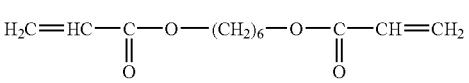

EXAMPLE 3

As mentioned above, when a spherical toner having a small particle diameter is used, it is preferable to apply a relatively high pressure per unit area to the cleaning blade 2 in order to prevent residual toner particles from entering the nip between the blade and the surface of the photoreceptor. In this case, the abrasion loss of the blade and the surface of the photoreceptor tends to be increased. By applying a lubricant on the surface of the photoreceptor, the abrasion loss of the blade and the surface of the photoreceptor can be decreased.

In addition, when a charger utilizing discharging is used for charging the photoreceptor, the surface of the photoreceptor is gradually degenerated by the discharging, and thereby the surface energy of the photoreceptor is increased. In this case, defective cleaning tends to be caused particularly when a spherical toner is used. By applying a lubricant on the surface of the photoreceptor, occurrence of such defective cleaning can be prevented even after long repeated cleaning operations.

In Example 3, a process unit having a lubricant application device will be explained.

Figure 23:
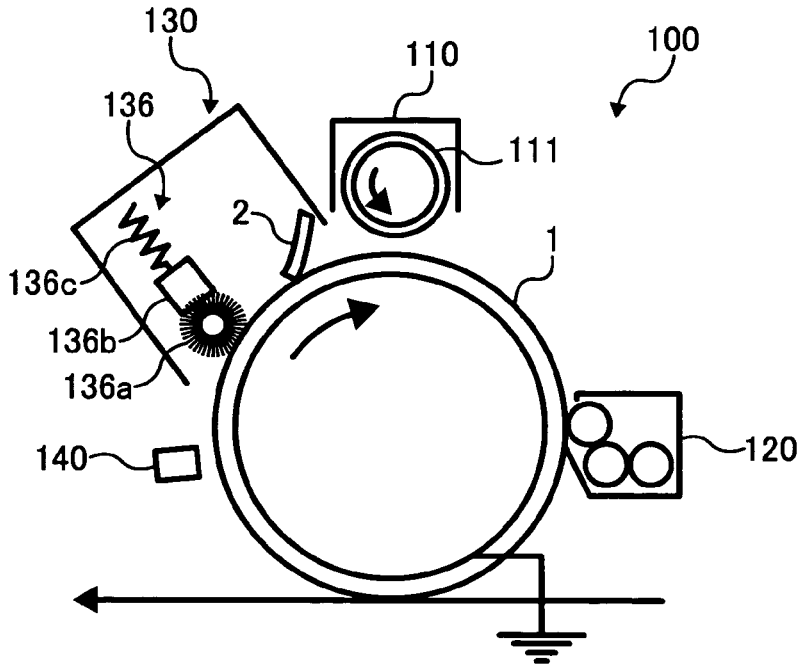
FIG. 23 is a schematic view illustrating another example of the process unit of the present invention, which is used for Example 3.

FIG. 23 is a schematic view illustrating another example of the process unit 100 and other devices in the vicinity thereof. The process unit 100 includes a photoreceptor cleaning unit 130. The cleaning unit 130 includes the cleaning blade 2 and a brush unit 136 which serves as a lubricant applicator and applies a lubricant 136*b* on the surface of the photoreceptor 1 and which is located on an upstream side from the cleaning blade relative to the rotation direction of the photoreceptor. The brush unit 136 has a fur brush 136*a* and a spring 136*c* which presses the lubricant 136*b* and the fur brush 136*a* toward the photoreceptor 1.

The fur brush 136*a* is a brush roller in which a number of raising hairs made of acrylcarbon are planted on a core material. The fur brush 136*a* is clockwise rotated so that the brush scrapes off the surface of the lubricant 136 to apply the thus scraped off lubricant to the surface of the photoreceptor while the raising hairs is rubbing the surface of the photoreceptor. When a lubricant is directly applied to the surface of the photoreceptor without using such a brush roller, a problem such that the lubricant is unevenly abraded, and thereby the lubricant is unevenly applied to the surface of the photoreceptor tends to be caused. Therefore, it is preferable to use a brush roller to prevent occurrence of such a problem.

By changing the revolution of the fur brush 136*a*, the coating amount of the lubricant 136*b* can be changed.

In the cleaning device 136, since the lubricant 136 is applied before the cleaning operation using the cleaning blade 2, residual toner particles are coated with the lubricant by the fur brush 136*a*, and thereby the residual toner particles can be easily removed from the surface of the photoreceptor 1 by the cleaning blade 2.

Specific examples of the lubricant include solidified metal soaps such as zinc stearate, calcium stearate, magnesium stearate, barium stearate, and aluminum stearate. Among these materials, powders of crystals having a lamellar crystal structure such as zinc stearate are preferably used. The lamellar crystal structure is such that amphipathic molecules of a material (zinc stearate) are self-organized and form overlaid layers. Therefore, when a shearing force is applied to such crystal, the crystals are easily divided at the interfaces between the layers. Because of having this property, zinc stearate can impart low friction coefficient to a material (the photoreceptor). In addition, other lubricants such as fatty acids and salts thereof, waxes, silicone oils, etc., can also be used.

Specific examples of the fatty acids include undecylic acid, lauric acid, tridecylic acid, myristic acid, palmitic acid, pentadecylic acid, stearic acid, heptadecylic acid, arachidic acid, montanic acid, oleic acid, arachidonic acid, caprylic acid, caprylic acid, caproic acid, etc. Specific examples of the salts of fatty acids include Zn, Fe, Cu, Mg, Al, and Ca salts of the above-mentioned fatty acids.

MODIFIED EXAMPLE 1

Figure 24:
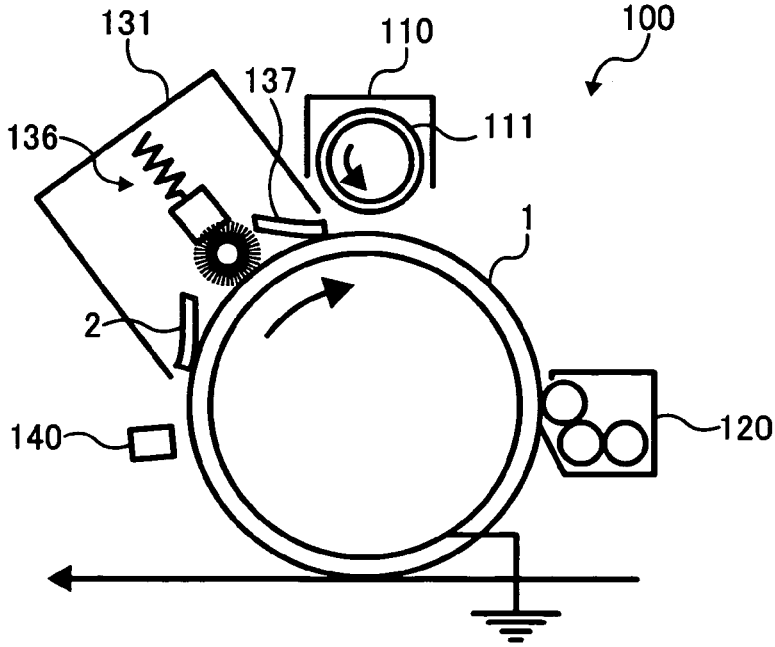
FIG. 24 is a schematic view illustrating another example of the process unit of the present invention, which is used for Modified Example 1.

FIG. 24 is a schematic view illustrating a modified version of the process unit 100 for use in the printer 200 of Example 3.

In this process unit 100, a lubricant is applied to the surface of the photoreceptor 1 by the lubricant applicator 136 of a cleaning device 131, wherein the surface of the photoreceptor has been subjected to a cleaning operation using a cleaning blade 2. In addition, the cleaning device 131 includes a uniformizing blade 137, which is contacted with the surface of the photoreceptor at a location between the brush unit 136 and the charging device 110 to uniformize the applied lubricant.

In the cleaning device 130 illustrated in FIG. 23, the lubricant 136*b* is applied before the cleaning operation using the cleaning blade 2. In this case, a part of the applied lubricant is removed by the blade 2 from the surface of the photoreceptor 1 together with residual toner particles. Therefore, the friction coefficient decreasing effect of the lubricant is slightly weakened. In addition, when a large particle of the lubricant is applied to the photoreceptor and the particle reaches the nip between the blade 2 and the photoreceptor 1, the blade is pressed upward, and thereby residual toner particles and/or free particles of the external additive of the toner pass through the nip, resulting in occurrence of the defective cleaning problem.

In contrast, in the cleaning device illustrated in FIG. 24, a lubricant is applied after the cleaning operation using the blade 2. Therefore, the lubricant can be evenly applied to the surface of the photoreceptor 1. In addition, since the applied lubricant is uniformized by the uniformizing blade 137, occurrence of defective cleaning caused by a large particle of the lubricant can be prevented.

The uniformizing blade 137 is preferably made of an elastic material such as urethane rubbers. In addition, the uniformizing member is not limited to a blade, and an elastic roller can also be used.

The process unit 100 of Example 3 includes the cleaning device of the present invention. When a process unit having no cleaning device is used for an image forming apparatus, the cleaning device of the present invention is set in the image forming apparatus.

A toner having an average circularity of not less than 0.98 and a volume average particle diameter of 5 μm is used for the printer 200.

The average circularity of the toner is determined by the following method using a flow-type particle image analyzer FPIA-2000 from Sysmex Corp.

Average Circularity (1) at first 100 to 150 ml of water from which solid foreign materials have been removed, 0.1 to 0.5 ml of a surfactant (alkylbenzenesulfonate) and 0.1 to 0.5 g of the toner particles were mixed to prepare a dispersion;

(2) the dispersion is further subjected to a supersonic dispersion treatment for 1 to 3 minutes using a machine manufactured by Honda Denshi Co., Ltd. to prepare a dispersion including particles of from 3,000 to 10,000 pieces/μl;

(3) the dispersion is passed through a detection area formed on a plate in the measuring instrument; and (4) the particles are optically detected by a CCD camera and then the shapes thereof are analyzed with an image analyzer.

Figure 25:
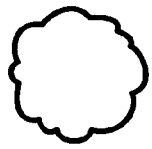
FIGS. 25 and 26 are schematic views for explaining the way to determine the circularity of a toner.
Figure 26:
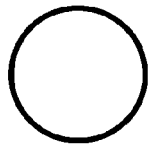

The circularity of a particle is determined by the following equation:

$$\text{Circularity}=L2/L1,$$

wherein L2 represents the length of the circumference of the projected image of a particle as illustrated in FIG. 25 and L1 represents the length of the circumference of a circle having the same area (S) as that of the projected image of the particle as illustrated in FIG. 26.

The volume average particle diameter of the toner is determined by a method using a MULTISIZER 2e (from Beckmann Coulter, Inc.), an interface (from Nikkaki Bios) and a personal computer. The procedure is as follows.

At first, a surfactant serving as a dispersant (preferably 0.1 to 5 ml of a 1% aqueous solution of an alkylbenzenesulfonic acid salt) is added to 100 to 150 ml of an electrolyte. As the electrolyte, a 1% aqueous solution of first class NaCl is used. Then 2 to 20 mg of a sample to be measured is added into the mixture. The thus prepared suspension is subjected to an ultrasonic dispersion treatment for about 1 to 3 minutes. The volume and number of toner particles are measured using the instrument mentioned above and an aperture of 100 μm to determine the volume particle diameter distribution. In this regard, particle diameters of 50,000 toner particles are measured to determine the volume particle diameter distribution of the toner.

In addition, the particle diameter channels are the following 13 channels:

2.00 μm≦C1<2.52 μm; 2.52 μm≦C2<3.17 μm;
3.17 μm≦C3<4.00 μm; 4.00 μm≦C4<5.04 μm;
5.04 μm≦C5<6.35 μm; 6.35 μm≦C6<8.00 μm;
8.00 μm≦C7<10.08 μm; 10.08 μm≦C8<12.70 μm;
12.70 μm≦C9<16.00 μm; 16.00 μm≦C10<20.20 μm;
20.20 μm≦C11<25.40 μm; 25.40 μm≦C12<32.00 μm; and
32.00 μm≦C13<40.30 μm.

Thus, particles having a particle diameter not less than 2.00 μm and less than 40.30 μm are targeted in this particle diameter measurement method. The volume average particle diameter is determined using the following equation:

$$Dv=\Sigma XfV/\Sigma fV$$

wherein X represents the representative diameter of a channel, V represents the volume of a toner particle having the representative diameter of the channel, and f represents the number of toner particles having a particle diameter in the channel.

Toner having such a high circularity is typically prepared by a polymerization method. However, it may be possible to prepare such a toner using a pulverization method in near future. When such a spherical toner is used, the above-mentioned cleaning problem is easily caused if a conventional cleaning blade is used.

Figure 27:
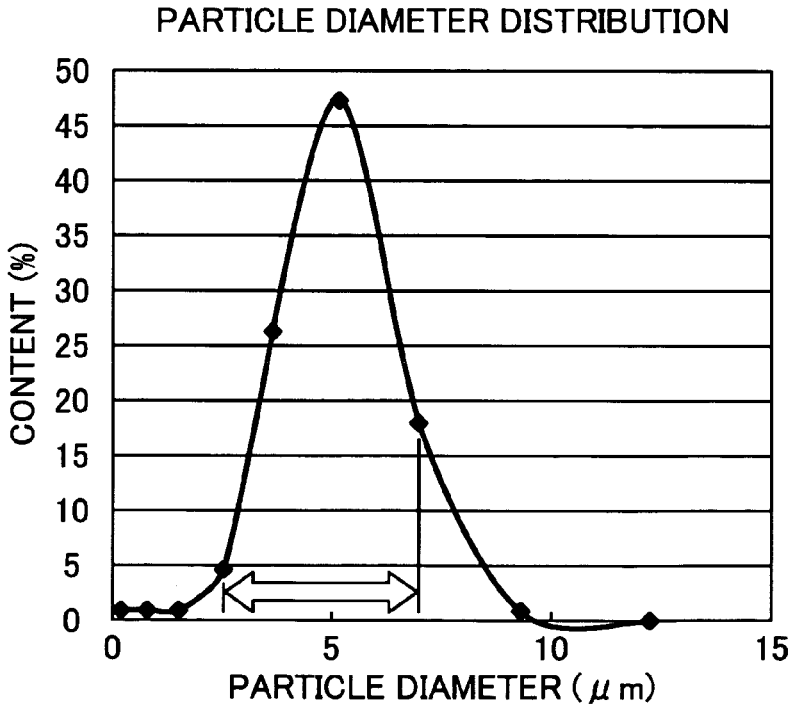
FIG. 27 is a graph illustrating the particle diameter distribution of the toner used for Examples.

The toner used for the above-mentioned experiments has an average circularity of not less than 0.98, a volume average particle diameter of 5 μm and a particle diameter distribution as illustrated in FIG. 27. As can be understood from FIG. 27, 95% of toner particles have a particle diameter of from 2.5 to 7.0 μm. Therefore, toner particles remaining on the surface of the photoreceptor also have the same particle diameter distribution.

In the photoreceptor cleaning device of this first embodiment, the following relationship (2) is satisfied:

$$Wc>We \quad (2)$$

wherein Wc represents the width (in the rotation direction of the photoreceptor) of the edge of the central portion 2*c* of the blade 2 contacted with the surface of the photoreceptor 1, and We represents the width of the edge of the end portions 2*c* of the blade 2 contacted with the surface of the photoreceptor 1.

In order that the above-mentioned relationship (2) is satisfied, the edge angle (Ae) of the edge of the end portions (2*e*) is set to be obtuse and greater than the edge angle (Ac) of the edge of the central portion 2*c*, which is not less than 90°. Since the edge angle can be changed independently of the linear pressure, the contact width can be changed independently of the linear pressure. Therefore, even when the linear pressure applied to the end portions is decreased due to positional variations of the set blade and photoreceptor, the contact pressure of the edge of the end portions can be controlled so as not to be less than the target value. Therefore, the cleaning device has good cleanability.

When the edge angle (Ae) of the end portions 2*e* of the blade 2 is greater than the edge angle (Ac) of the central portion 2*c*, the width of the rolled-up portion of the edge of the end portions 2*e* is narrower than the width of the rolled-up portion of the edge of the central portions 2*c*. Therefore, relationship (2) (Wc>We) can be satisfied.

When the edge angle (Ac) of the central portion 2*c* of the blade 2 is greater than 90°, the contact area of the edge of the central portion 2*c* contacted with the photoreceptor is smaller than the contact area in the case where the edge portion has an angle of not greater than 90°. Therefore, even when the same load is applied, the contact pressure can be increased. Accordingly, occurrence of the problem in that toner particles pass through the nip between the blade and the surface of the photoreceptor can be effectively prevented. Further, when the edge angle (Ac) is controlled so as to be not greater than 140°, occurrence of the problem in that toner particles enter into the V-shaped space formed by the cut surface of the tip of the blade and the surface of the photoreceptor, resulting in occurrence of defective cleaning, can be prevented because the angle of the V-shaped space is not so low.

By setting the edge angle (Ac) to be 115°, the desired contact pressure of 3.0 MPa can be obtained by applying a linear pressure of about 0.40 N/cm to the central portion 2*c*, which linear pressure is much lower than that (0.95 N/cm) in the case where the edge angle (Ac) is 90°.

In addition, the blade preferably satisfies the following relationship (1).

$$1.75 \leqq t2/t1 \leqq 3.00 \quad (1)$$

wherein t1 represents the thickness of the blade 2, and t2 represents the length of the free portion of the blade. When the cleaning device satisfies the relationship, occurrence of a problem in that the blade 2 is suddenly bent at the junction of the blade 2 and the holder 132 and thereby the body of the blade is contacted with the photoreceptor, resulting in defective cleaning can be prevented.

The contact pressure at the contact portion of the blade and the surface of the photoreceptor is preferably not less than 3.0 MPa to securely remove spherical toner particles from the surface of the photoreceptor.

The width (in the rotation direction of the photoreceptor) of edge portion of the blade 2 contacted with the surface of the photoreceptor 1 is preferably not less than 10 μm to prevent occurrence of a cleaning problem in that the edge of the blade is unevenly contacted with the surface of the photoreceptor due to scratches and projections formed on the surface of the photoreceptor and to well perform a cleaning operation even when a spherical toner having a small particle diameter is used. The width of the edge contacted with the surface of the photoreceptor 1 is preferably not greater than 40 μm, and more preferably not greater than 30 μm. In this case, the contact pressure can be increased without applying a high linear pressure to the photoreceptor and thereby spherical toner particles having a small particle diameter can be well removed while preventing occurrence of a problem in that the surface of the photoreceptor is seriously abraded.

The linear pressure applied to the blade 2 is preferably controlled so as to be from 0.2 N/cm to 1.2 N/cm, and more preferably from 0.2 N/cm to 0.9 N/cm, to well remove spherical toner particles having a small particle diameter while preventing occurrence of a problem in that the surface of the photoreceptor is seriously abraded.

By controlling the angle of the edge portion so as to be from 95° to 140°, the contact width can be securely decreased and thereby the pressure per unit area can be increased without increasing the linear pressure.

The cleaning blade is preferably made of a material having a repulsion elasticity coefficient of not greater than 30% at 23° C. In this case, the stick-slip movement of the blade 2 can be avoided, and therefore, the pressure per unit area can be increased without increasing the linear pressure while abrasion of the cleaning blade 2 is decreased.

Since the toner used for the printer 200 has an average circularity of not less than 0.98, high definition images can be produced. Even when such a spherical toner is used, toner particles of the toner remaining on the surface of a photoreceptor, which cannot well removed by a conventional cleaning blade, can be well removed by the cleaning blade.

The process unit 100 of the present invention, which includes at least the above-mentioned cleaning device 130 and the photoreceptor 1, is detachably set in the printer 200. The process unit can well remove toner particles remaining on the surface of the photoreceptor even when the toner is a spherical toner having a small particle diameter. By using such a process unit 100, maintenance (such as replacement and repair of parts) of the printer and replenishment of toner can be easily performed and the printer can be miniaturized.

Since the image forming apparatus (i.e., the printer 200) is equipped with the cleaning blade mentioned above, the cleaning operation can be well performed while the contact pressure is increased without increasing the linear pressure and abrasion of the cleaning blade 2 is decreased.

By including a particulate inorganic material and/or a crosslinked binder resin in the outermost layer of the photoreceptor, the abrasion resistance of the photoreceptor can be improved. Therefore, the printer 200 can produce high quality images without frequently replacing the photoreceptor. In addition, by including a binder resin having a charge transport structure in the outermost layer of the photoreceptor, the electric stability of the photoreceptor can be increased, and thereby high quality images can be produced.

By providing a lubricant applicator such as the brush unit 136 in the image forming apparatus, the abrasion loss of the photoreceptor can be further decreased, and therefore the printer 200 can produce high quality images for a long period of time without frequently replacing the photoreceptor.

Second Embodiment

In the first embodiment, the edge angle (Ae) of the end portions 2*e* of the blade is set so as to be greater than the edge angle (Ac) of the central portion 2*c* thereof to satisfy relationship (2) (Wc>We), wherein Wc represents the width of the portion of the edge of the central portion 2*c* contacted with the photoreceptor, and We represents the width of the portion of the edge of the end portions 2*c* contacted with the photoreceptor. However, the factor of influencing relationship (2) is not limited to the edge angle.

In this second embodiment, the material constituting the end portions 2*e* is differentiated from the material constituting the central portion 2*c* to satisfy relationship (2) (Wc>We).

Figure 28A:
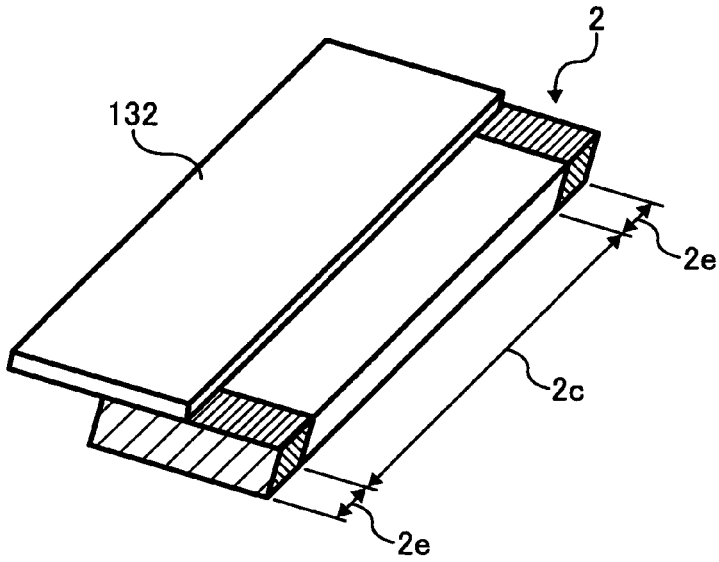
FIGS. 28A-28C are schematic views illustrating another example of the cleaning blade of the present invention, which is used for Second Embodiment.
Figure 28B:
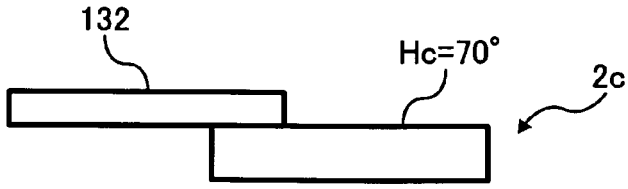
Figure 28C:
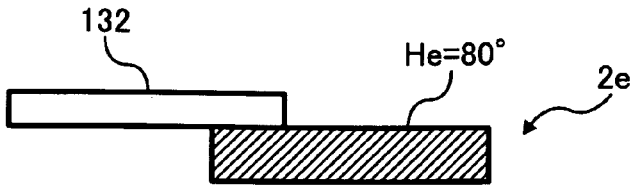

FIGS. 28A-28C are schematic views illustrating the second embodiment of the cleaning blade for use in the cleaning device of the present invention. FIG. 28A is a perspective view of the cleaning blade, and FIGS. 28B and 28C are views illustrating the cross-sections of a central portion 2*c* of the blade 2 and an end portion 2*e* of the blade 2, respectively.

As mentioned above, the end portions 2*e* tend to receive a relatively low linear pressure compared to the central portion 2*c*. In order to decrease the contact width at the end portions of the blade (to maintain a target contact pressure), a material having a small deformation property such that when the same pressure is applied to the material, the material is deformed to a degree smaller than that of the material used for the central portion 2*c* is used for the end portions.

For example, a material having a JIS-A hardness higher than that of the material used for the central portion 2*c* is used for the end portions to satisfy relationship (2), Wc>We. By using such a blade, residual toner particles can be well removed even when the toner is a spherical toner having a small particle diameter.

The materials used for the central portion and the end portions of the blade illustrated in FIGS. 28A-28C have JIS-A hardness of 80° and 70°, respectively. When the same linear pressure is applied to the central portion 2*c* and the end portions 2*e*, relationship (2) (Wc>We) can be satisfied. Even when the linear pressure applied to the end portions 2*e* is decreased due to positional variations of the set blade and the photoreceptor, a contact pressure not less than the target pressure can be applied to the end portions because the contact area of the end portions is relatively small compared to that of the central portion.

MODIFIED EXAMPLE 2

Figure 29A:
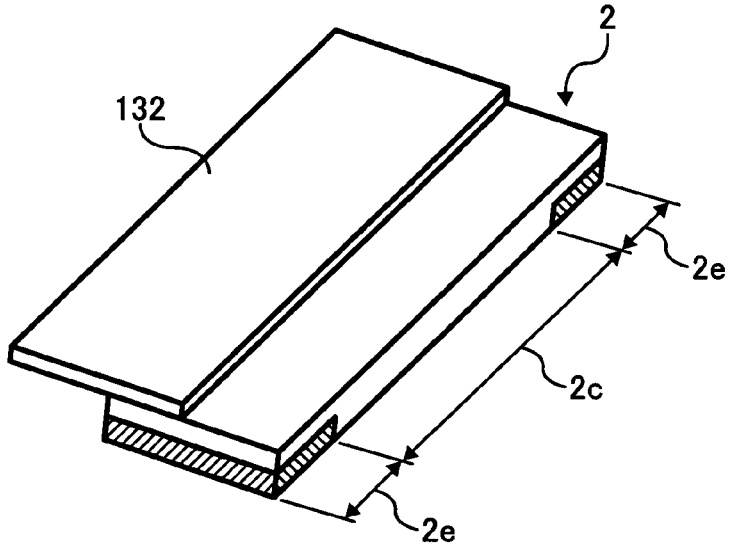
FIGS. 29A-29C are schematic views illustrating another example of the cleaning blade of the present invention, which is used for Modified Example 2.
Figure 29B:
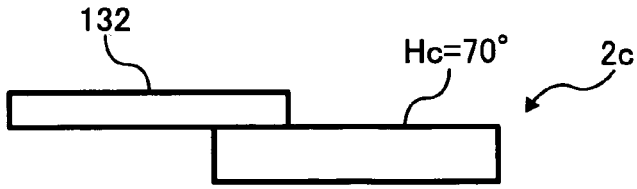
Figure 29C:
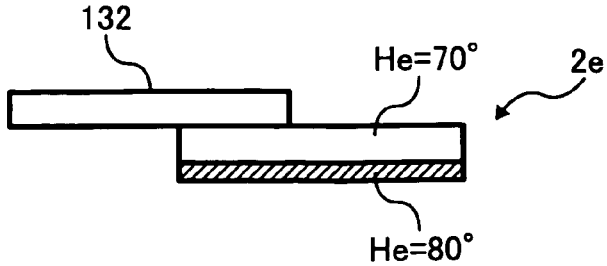

FIGS. 29A-29C are schematic views illustrating a first modified example in the second embodiment of the cleaning blade for use in the cleaning device of the present invention. FIG. 29A is a perspective view of the cleaning blade, and FIGS. 29B and 29C are views illustrating the cross-sections of a central portion 2*c* of the blade 2 and an end portion 2*e* of the blade 2, respectively.

The end portions 2*e* of the blade have a double-layered structure as illustrated in FIG. 29C. In this modified example, the hardness of the upper layer of the end portion 2*e* is 70°, and the hardness of the lower layer thereof is 80° (as illustrated in FIG. 29C), which is greater than the hardness (70°) of the central portion 2*c* (illustrated in FIG. 29B).

MODIFIED EXAMPLE 3

Figure 30A:
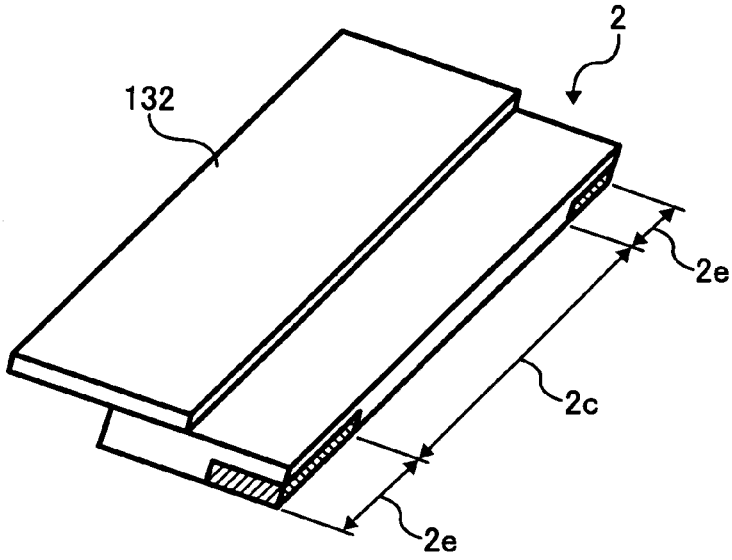
FIGS. 30A-30C are schematic views illustrating another example of the cleaning blade of the present invention, which is used for Modified Example 3.
Figure 30B:
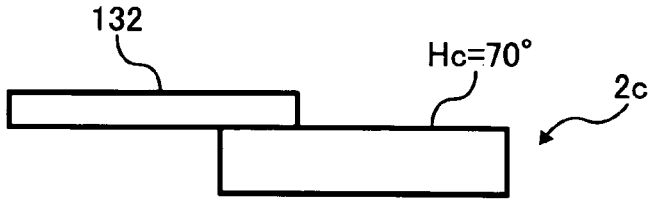
Figure 30C:
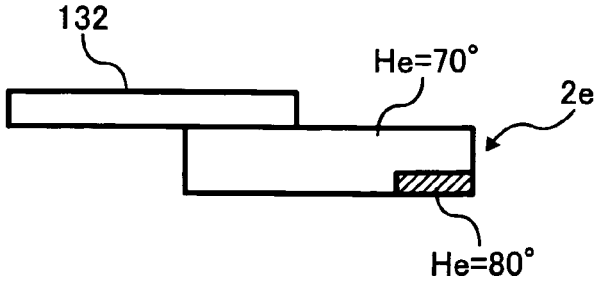

FIGS. 30A-30C are schematic views illustrating a second modified example in the second embodiment of the cleaning blade for use in the cleaning device of the present invention. FIG. 30A is a perspective view of the cleaning blade, and FIGS. 30B and 30C are views illustrating the cross-sections of a central portion 2*c* of the blade 2 and an end portion 2*e* of the blade 2, respectively.

The tip portion of the end portions 2*e* of the blade has a double-layered structure as illustrated in FIG. 30C. In this modified example, the hardness of the upper portion of the tip portion is 70°, and the hardness of the lower portion thereof is 80° (as illustrated in FIG. 30C), which is greater than the hardness (70°) of the central portion 2*c* (illustrated in FIG. 30B).

In the blades 2 illustrated in FIGS. 28-30, the hardness of the central portion 2*c* is 70°, and the hardness of the portion of the end portions contacted with the photoreceptor is 80°. However, the hardness is not limited thereto. In addition, it is possible to satisfy relationship (2) by changing the properties of at least the tip portion of the end portions contacted with the photoreceptor, such as modulus (100% modulus or 300% modulus defined in JIS) and Young's modulus, instead of the hardness.

Polyurethane rubbers are preferably used for the blade of the cleaning device of the present invention. For example, by changing the formulation of the rubbers, the hardness and/or the repulsion elasticity coefficient of the blade can be changed. The material used for the blade is not limited to polyurethane rubbers, and any materials can be used as long as the materials can maintain the target pressure per unit area.

As mentioned above, in this second embodiment, the hardness (He) of the end portions 2*e* is set so as to be greater than the hardness (Hc) of the central portion 2*c* to satisfy relationship (2). The hardness can be changed independently of the linear pressure. Therefore, even when the contact width (We) of the end portions is narrowed by changing the hardness of the end portions, the linear pressure is not influenced thereby. Therefore, even when the linear pressure applied to the end portions is decreased, a contact pressure of not less than the target pressure can be applied to the end portions. Therefore, the blade has good cleanability even when a spherical toner having a small average particle diameter is used.

Third Embodiment

In order to satisfy relationship (2) (Wc>We), the shape of the holder 132 is changed in the longitudinal direction thereof in this third embodiment.

Figure 31A:
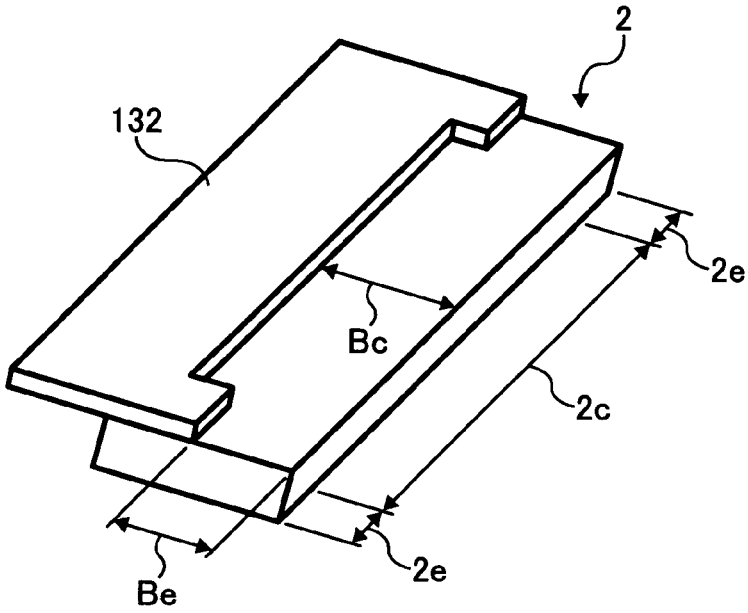
FIGS. 31A-31C are schematic views illustrating another example of the cleaning blade of the present invention, which is used for Third Embodiment.
Figure 31B:
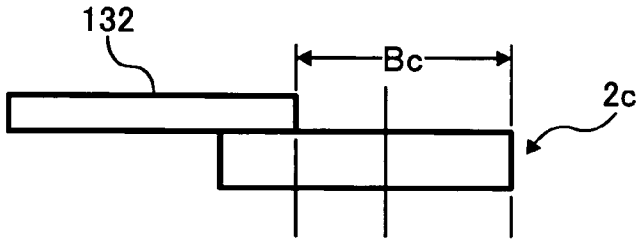
Figure 31C:
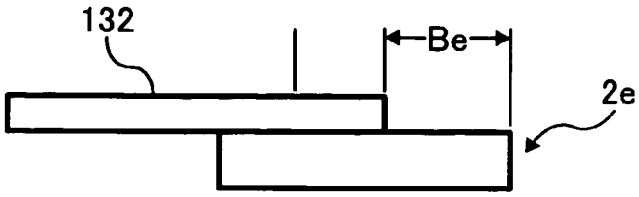

FIGS. 31A-31C are schematic views illustrating an example in the third embodiment of the cleaning blade for use in the cleaning device of the present invention. FIG. 31A is a perspective view of the cleaning blade, and FIGS. 31B and 31C are views illustrating the cross-sections of a central portion 2*c* of the blade 2 and an end portion 2*e* of the blade 2, respectively. As illustrated in FIGS. 31B and 31C, the length of the holder 132 at the end portions 2*e* is different from the length thereof at the central portion 2*c*. Namely, the length of the free portion of the blade at the end portions 2*e* is, different from the length thereof at the central portion 2*c*.

Specifically, since the length of the holder 132 at the end portions 2*e* is longer than thereof at the central portion 2*c*, a length (Be) of the free portion of the blade at the end portions 2*e* is shorter than a length (Bc) thereof at the central portion 2*c*. Since the length (Be) of the free portion of the end portions 2*e* is shorter than that (Bc) of the free portion of the central portion 2*c*, the bending degree of the end portions is smaller than that of the central portion, and thereby relationship (2) can be satisfied. Therefore, even when the linear pressure applied to the end portions is accidentally decreased, a contact pressure of not less than the target pressure can be applied to the end portions because the contact width is small. Therefore, the blade has good cleanability even when a spherical toner having a small average particle diameter is used.

As mentioned above, in this third embodiment, the length (Be) of the portion of the holder 132 corresponding to the end portions 2*e* of the blade 2 is set so as to be longer than the length (Bc) of the central portion 2*c* to satisfy relationship (2) (Wc>We). The length of the holder can be changed independently of the linear pressure. Therefore, even when the contact width (We) of the end portions is narrowed by changing the length of the holder, the linear pressure is not influenced thereby. Therefore, even when the linear pressure applied to the end portions is decreased due to positional variations of the set blade and photoreceptor, a contact pressure of not less than the target pressure can be applied to the end portions. Therefore, the blade has good cleanability even when a spherical toner having a small average particle diameter is used.

Fourth Embodiment

In order to satisfy relationship (2) (Wc>We), the shape of the cleaning blade 2 is changed in the longitudinal direction thereof in this fourth embodiment.

Figure 32A:
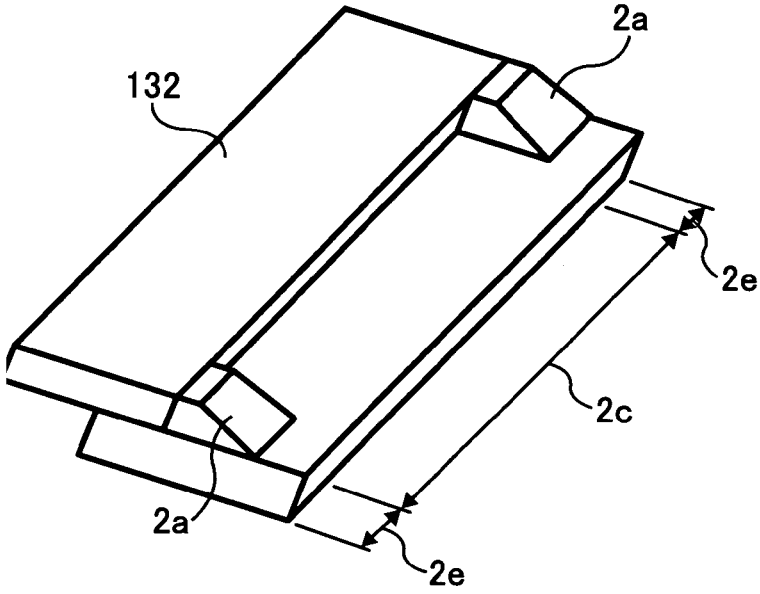
FIGS. 32A-32C are schematic views illustrating another example of the cleaning blade of the present invention, which is used for Fourth Embodiment.
Figure 32B:
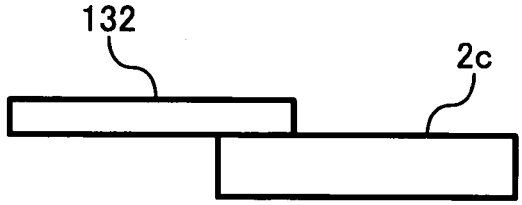
Figure 32C:
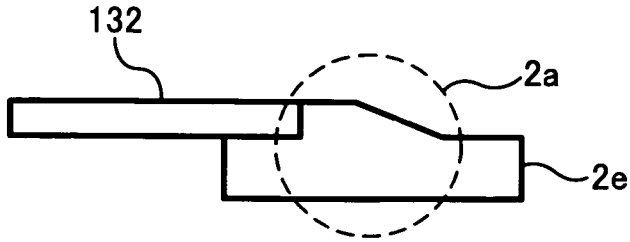

FIGS. 32A-32C are schematic views illustrating an example in the fourth embodiment of the cleaning blade for use in the cleaning device of the present invention. FIG. 32A is a perspective view of the cleaning blade, and FIGS. 32B and 32C are views illustrating the cross-sections of the central portion 2*c* of the blade 2 and the end portions 2*e* of the blade 2, respectively. As illustrated in FIGS. 32A-32C, the end portions 2*e* have a reinforcing structure. Specifically, in this example, the end portions 2*e* of the blade 2 have a thick portion 2*a*, which is similar to the thick portion 2*a* illustrated in FIG. 8. Specifically, the blade 2 is set such that the rear end of the thick portion 2*a* is contacted with the front end of the holder and the rear upper surface of the blade is adhered to the lower surface of the holder.

Since the end portions 2*e*, which have a reinforced structure (i.e., the thick portion), the bending degree of the end portions 2*e* is smaller than that of the central portion 2*c*, and thereby relationship (2) (Wc>We) can be satisfied. Therefore, even when the linear pressure applied to the end portions is decreased due to positional variations of the set blade and photoreceptor, a pressure per unit area of not less than the target pressure can be applied to the end portions. Therefore, the blade has good cleanability even when a spherical toner having a small average particle diameter is used.

Fifth Embodiment

In the first to fourth embodiments, the cleaning devices are used for cleaning the surface of an image bearing member. However, the member to be cleaned is not limited thereto.

In this fifth embodiment, a cleaning device for cleaning the surface of a charging roller will be explained.

Figure 33:
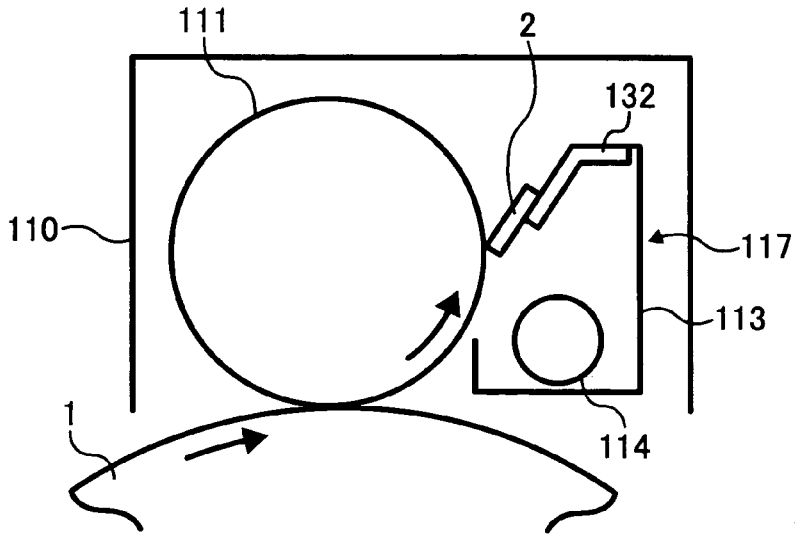
FIG. 33 is a schematic view illustrating the charger used for Fifth Embodiment.

FIG. 33 is a schematic view illustrating a charging device 110 having a cleaning device for cleaning the charging roller 111. Since the cleaning device is similar to the cleaning device mentioned above for use in cleaning the photoreceptor, only the different portions will be explained.

The charging device 110 includes a cleaning device 117 for removing toner particles adhered to a charging roller 111. The cleaning device 117 includes a casing 113, the holder 132 serving as a support of the blade 2, the elastic cleaning blade 2 and a toner collection screw 114.

When the toner particles, which still remain on the surface of the photoreceptor 1 without being removed by the photoreceptor cleaning blade even after the cleaning operation, reach the charging region, some of the toner particles are adhered to the charging roller 111, which is contacted with the surface of the photoreceptor 1 or is arranged so as to be close to the surface of the photoreceptor 1. The toner particles thus adhered to the surface of the charging roller 111 are removed by the cleaning blade of the cleaning device 117.

The cleaning blades mentioned above for use in the photoreceptor cleaning device 130 are used for the cleaning blade 2 of the charging roller cleaning device 117. Therefore, toner particles adhered to the charging roller 111 can be well removed therefrom. Since residual toner particles can be well removed, a contact charging roller can be used as the charging roller 111.

The charging device 110 may be a process unit, which includes at least the charging roller cleaning device 117 and the charging roller 111 and which is detachably set to the image forming apparatus (i.e., the printer 200).

Sixth Embodiment

In this sixth embodiment, a cleaning device for cleaning the surface of an intermediate transfer medium will be explained.

Figure 34:
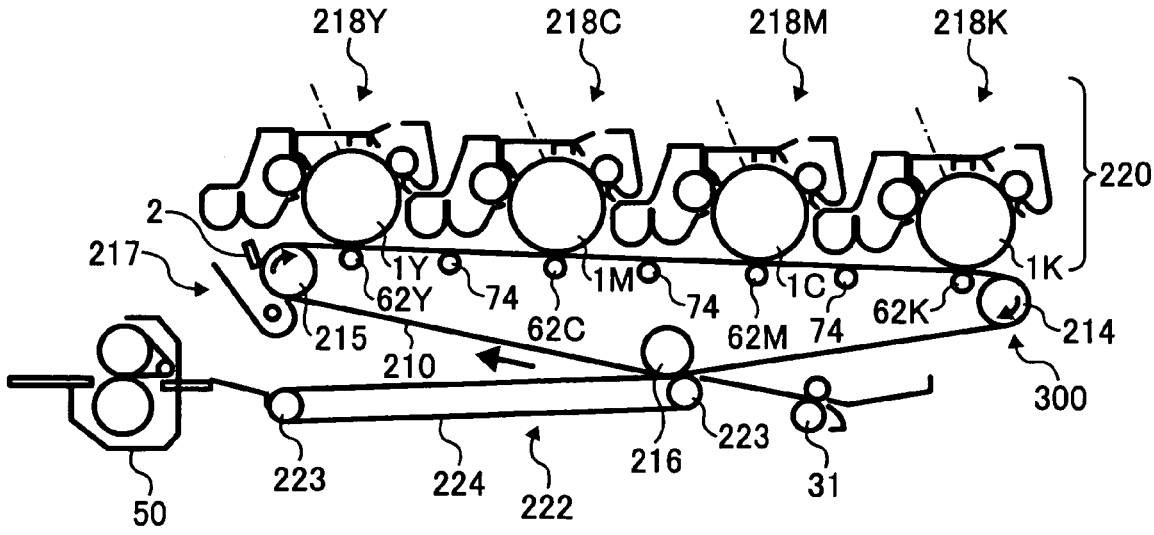
FIG. 34 is a schematic view illustrating the image forming section including an intermediate transfer unit, which is used for Sixth Embodiment.

FIG. 34 is a schematic view illustrating an image forming section including an intermediate transfer unit. This intermediate transfer unit is used for an image forming apparatus other than the printer 200 illustrated in FIG. 2.

Referring to FIG. 34, an intermediate transfer unit 300 includes an intermediate transfer belt 210, a belt cleaning device 217, a tension roller 214, a driving roller 215, a secondary transfer backup roller 216, four bias rollers 62 (i.e., 62Y, 62C, 62M and 62K), three ground rollers 74, etc.

The intermediate transfer roller 210 is rotated clockwise by the driving roller 215, which is driven by a belt driving motor (not shown), while tightly stretched by ten rollers including the tension roller 214 and the driving roller 215. The four bias rollers 62 are arranged so as to be contacted with the inner surface of the intermediate transfer belt 210, and receive an intermediate transfer bias from a power source (not shown). In addition, the four bias rollers 62 press the intermediate transfer belt 210 toward the photoreceptors 1 (i.e., 1Y, 1M, 1C and 1K), and thereby four intermediate transfer nips are formed between the photoreceptors 1 and the intermediate transfer belt 210. Since the intermediate transfer bias is applied to the four intermediate transfer nips, an intermediate transfer electric field is formed on each of the four intermediate transfer nips. At first, a yellow toner image formed on the photoreceptor 1Y is transferred onto the intermediate transfer belt 210 due to the intermediate transfer electric field and the pressure applied to the nip. Similarly, magenta, cyan and black toner images are sequentially transferred on the yellow toner image on the intermediate transfer belt 210. Thus, a four-color toner image constituted of the layered yellow, magenta, cyan and black toner images is formed on the intermediate transfer belt 210.

The ground rollers 74 are made of an electroconductive material and are contacted with the inner surface of the intermediate transfer belt 210 at three locations between any two adjacent transfer nips. The ground rollers 74 are provided to prevent the intermediate transfer bias applied to a transfer nip from influencing the adjacent transfer nip and other process units.

The four-color toner image on the intermediate transfer belt 210 is then secondarily transferred onto a receiving material (not shown) at the below-mentioned secondary transfer nip. Toner particles remaining on the intermediate transfer belt 210 are removed by the blade 2 of the belt cleaning device 217. In this case, the intermediate transfer belt 210 is sandwiched by the blade 2 and the driving roller 215 as illustrated in FIG. 34.

The cleaning blades mentioned above for use in the photoreceptor cleaning device mentioned above can also be used for the intermediate transfer belt cleaning device. By using the cleaning blades, residual toner particles on the intermediate transfer belt 210 can be well removed, and thereby clear full color images can be produced because occurrence of a color mixing problem caused by residual toner particles can be prevented.

The intermediate transfer unit 300 serving as a process unit includes at least the cleaning device 217 and the intermediate transfer belt 210 and can be detachably attached to an image forming apparatus (not shown).

In FIG. 34, numerals 220 denotes an image forming section including four color image forming units 218Y, 218C, 218M and 218K. Numeral 222 denotes a paper feeding device for feeding a receiving material. The paper feeding device includes a feeding belt 224 rotated while tightly stretched by rollers 223.

This document claims priority and contains subject matter related to Japanese Patent Applications Nos. 2005-179622 and 2005-260645, filed on Jun. 20, 2005, and Sep. 8, 2005, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A cleaning device, comprising:

an elastic blade whose tip is contacted with a surface of a rotated member in such a manner as to counter the rotated member to remove particles of a toner on the rotated member; and a holder configured to support the elastic blade, wherein a nip formed by a tip of longitudinal end portions of the blade and the surface of the rotated member has a first nip width in a rotation direction of the rotated member, and a nip formed by a tip of a central portion of the blade and the surface of the rotated member has a second nip width, the first nip width is less than the second nip width, and the elastic blade satisfies the following relationships $$Ac<Ae \text{ and } 90°<Ac<140°,$$

wherein Ac represents an angle of a tip edge of the central portion of the blade contacted with the surface of a photoreceptor, and Ae represents an angle of a tip edge of the end portions of the blade contacted with the surface of a photoreceptor.

2. The cleaning device according to claim 1, wherein the elastic blade satisfies the following relationship:

$$Hc<He$$

wherein Hc represents a hardness of the tip of the central portion of the blade contacted with the surface of the photoreceptor, and He represents a hardness of the tip of the end portions of the blade contacted with the surface of the photoreceptor.

3. The cleaning device according to claim 1, wherein the elastic blade satisfies the following relationship:

$$t1<t2$$

wherein t1 represents a thickness of the elastic blade, and t2 represents a distance between a front end of the holder and the tip of the elastic blade contacted with the surface of the rotated member.

4. The cleaning device according to claim 3, wherein the elastic blade satisfies the following relationship:

$$1.75 \leqq t2/t1 \leqq 3.00.$$

5. The cleaning device according to claim 1, wherein the elastic blade satisfies the following relationship:

$$Bc>Be$$

wherein Bc represents the distance between a front end of the holder and the tip of the elastic blade contacted with the surface of the rotated member at the end portions of the blade, and Be represents the distance between a front end of the holder and the tip of the elastic blade contacted with the surface of the rotated member at the central portion of the blade.

6. The cleaning device according to claim 1, wherein each of the longitudinal end portions of the elastic blade has a reinforcing portion.

7. The cleaning device according to claim 6, wherein the each of the longitudinal end portions of the elastic blade has a thick portion having a thickness greater than the tip of the elastic blade as the reinforcing portion, wherein a rear surface of the thick portion is contacted with a front end of the holder.

8. The cleaning device according to claim 1, wherein a pressure per unit area applied to the tip of the central portion of the blade contacted with the surface of the photoreceptor, and a pressure per unit area applied to the tip of each of the end portions of the blade contacted with the surface of the photoreceptor are not less than 3.0 MPa.

9. The cleaning device according to claim 1, wherein the first nip width and the second nip width are not less than 10 μm.

10. The cleaning device according to claim 1, wherein the first nip width and the second nip width are not greater than 40 μm.

11. The cleaning device according to claim 1, wherein a linear pressure applied to the tip of the central portion of the blade contacted with the surface of the photoreceptor, and a linear pressure applied to the tip edge of each of the end portions of the blade contacted with the surface of the photoreceptor are from 0.2 to 1.2 N/cm.

12. The cleaning device according to claim 1, wherein the elastic blade has a repulsion elasticity of not greater than 30% at 23° C.

13. The cleaning device according to claim 1, wherein the toner has an average circularity of not less than 0.98.

14. A process unit, comprising:

a rotating member; and a cleaning device configured to remove particles of a toner on the rotating member, wherein the cleaning device is the cleaning device according to claim 1, and the process unit is detachably attached to an image forming apparatus.

15. An image forming apparatus, comprising:

a latent image bearing member;

a charger configured to charge the latent image bearing member;

a latent image forming device configured to form an electrostatic latent image on the latent image bearing member;

a developing device configured to develop the electrostatic latent image with a developer including a toner to form a toner image;

a transfer device configured to transfer the toner image onto a receiving material; and a cleaning device configured to remove particles of the toner present on at least one rotating member, wherein the cleaning device is the cleaning device according to claim 1.

16. The image forming apparatus according to claim 15, wherein the latent image bearing member has an outermost layer comprising a particulate inorganic material.

17. The image forming apparatus according to claim 15, wherein the latent image bearing member has an outermost layer comprising a crosslinked resin.

18. The image forming apparatus according to claim 15, wherein the latent image bearing member has an outermost layer comprising a polymer having a charge transport ability.

19. A cleaning device, comprising:

an elastic blade whose tip is contacted with a surface of a rotated member in such a manner as to counter the rotated member to remove particles of a toner on the rotated member; and a holder configured to support the elastic blade, wherein a nip formed by a tip of longitudinal end portions of the blade and the surface of the rotated member has a first nip width in a rotation direction of the rotated member, and a nip formed by a tip of a central portion of the blade and the surface of the rotated member has a second nip width, wherein the first nip width is less than the second nip width, and a pressure per unit area applied to the tip of the central portion of the blade contacted with the surface of the photoreceptor, and a pressure per unit area applied to the tip of each of the end portions of the blade contacted with the surface of the photoreceptor are not less than 3.0 MPa.

20. A cleaning device, comprising:

an elastic blade whose tip is contacted with a surface of a rotated member in such a manner as to counter the rotated member to remove particles of a toner on the rotated member; and a holder configured to support the elastic blade, wherein a nip formed by a tip of longitudinal end portions of the blade and the surface of the rotated member has a first nip width in a rotation direction of the rotated member, and a nip formed by a tip of a central portion of the blade and the surface of the rotated member has a second nip width, wherein the first nip width is less than the second nip width, and the first nip width and the second nip width are not greater than 40 μm.

* * * * *